US005744287A

United States Patent [19]

Roberts et al.

[11] Patent Number: 5,744,287

[45] Date of Patent: Apr. 28, 1998

[54] PHOTOGRAPHIC SILVER HALIDE MEDIA FOR DIGITAL OPTICAL RECORDING

[75] Inventors: Michael Richard Roberts; Alphonse Dominic Camp, both of Rochester; Richard Lee Parton, Webster; Daniel John Collins, Rochester, all of N.Y.

[73] Assignee: Eastman Kodak Company, Rochester, N.Y.

[21] Appl. No.: 560,551

[22] Filed: Nov. 17, 1995

[51] Int. Cl.[6] ..... G03C 7/30

[52] U.S. Cl. ..... 430/363; 430/503; 430/505; 430/509; 430/604; 430/945

[58] Field of Search ..... 430/363, 505, 430/945, 509, 567, 616, 604, 503

[56] References Cited

U.S. PATENT DOCUMENTS

| | | |
|---|---|---|
| 3,728,121 | 4/1973 | Zorn et al. . |
| 4,201,841 | 5/1980 | Groet et al. . |
| 4,619,892 | 10/1986 | Simpson et al. . |
| 4,729,943 | 3/1988 | Pfaff et al. . |
| 4,828,962 | 5/1989 | Grzeskowiak et al. . |
| 5,057,405 | 10/1991 | Shiba et al. . |
| 5,084,374 | 1/1992 | Waki et al. . |
| 5,290,655 | 3/1994 | Iwasaki . |

FOREIGN PATENT DOCUMENTS

| | | |
|---|---|---|
| 0 530 827 | 3/1993 | European Pat. Off. . |
| 0 617 318 | 9/1994 | European Pat. Off. . |
| 63-205653 | 8/1988 | Japan . |
| 5142712 | 6/1993 | Japan . |

*Primary Examiner*—Thorl Chea
*Attorney, Agent, or Firm*—Paul A. Leipold

[57] ABSTRACT

The invention relates to a photographic element comprising a layer comprising a cyan dye forming coupler, a layer comprising a magenta dye forming coupler and a layer comprising a yellow dye forming coupler, wherein said layers further comprise silver halide emulsions, said emulsions comprise greater than 95 percent chloride and said element when exposed at less than 50 microseconds per pixel in each color record and at a resolution between 200 and 500 pixels per inch provides after development a maximum gamma between 3.4 and 6.0 in at least one color record layer within a log exposure range not exceeding 1.1.

23 Claims, 3 Drawing Sheets

PHOTOGRAPHIC SILVER HALIDE MEDIA FOR DIGITAL OPTICAL RECORDING

FIELD OF THE INVENTION

The present invention relates to photographic silver halide media for recording digital images, and a method for printing digital images at high density with improved sharpness.

BACKGROUND OF THE INVENTION

Of the artifacts associated with printing digital images onto silver halide media, formation of visually soft or "bleeding" edges, especially around text, probably elicits the greatest objections. In the current invention this artifact is designated "digital fringing", and it pertains to unwanted density formed in an area of a digital print as a result of a scanning exposure in a different area of the print, not necessarily in adjacent pixels. Digital fringing may be detected in pixels many lines away from area(s) of higher exposure, creating an underlying Dmin that reduces sharpness and degrades color reproduction. It should not be confused with system flare arising from improper calibration, which produces a similar macroscopic defect.

Digital fringing may be observed even with exposures producing mid scale densities. The minimum exposure at which digital fringing becomes visually objectionable varies by digital printing device and emulsion photographic properties. Because fringing increases with exposure, the useful density range for typical commercial photographic papers printed by scanning laser or LED (light emitting diode) exposures must be restricted to 2.2 or below, less than the full density range of the papers. Fine line images require even lower print densities due to the acute sensitivity of the eye to softening of high contrast edges.

Other image artifacts associated with optical scan printing on silver halide media that should not be confused with digital fringing are "contouring", "banding", and "rastering". "Contouring" refers to the formation of discrete density steps in highlight regions where the gradations should appear continuous. Bit limited system modulators (those that use $\leqq 2^{10}$ bits, or 1024 DAC levels, designated 10 bit), may have too few levels to calibrate for density differences that are below the detection threshold of the human eye. A single bit change in exposure may, therefore, produce a density change large enough to see as a step, or contour. Lower contrast toe regions of the paper H&D curves can alleviate contouring in a 10 bit system, as taught by Kawai, Kokai JP 05/142712-A, but the low contrast also lowers the density threshold for digital fringing. System modulators using $2^{12}$ bits (designated 12 bit, having 4096 DAC levels) are not as susceptible to contouring artifacts. "Banding" is the appearance of lines, or bands, having a lower frequency than the individual raster lines, but which are parallel to the line scan direction. The bands arise from non-uniformity in the overlap exposure between scans (e.g., from mechanical vibrations) causing fluctuations in exposure in the overlap areas large enough to produce a visually detectable difference in density. "Rastering" is a high frequency artifact related to non-optimal spot size or shape which allows the eye to resolve the individual scan lines.

Those skilled in the art will recognize that the optical properties of the media (the scattering of light by the emulsion layers and paper base) contribute in part to digital fringing, which is a loss of acutance or sharpness. A general discussion of acutance as it pertains to structure of photographic media can be found in Mees & James, *Theory of the Photographic Process,* 4th Edition, Chapter 21. The spot shape and spot size used in scanning laser exposures also contribute to loss of sharpness.

PROBLEM TO BE SOLVED BY THE INVENTION

Because of the described deficiencies associated with printing digital images onto silver halide photographic media using optical scanning devices such as lasers or LEDs, it would be desirable to provide a media that achieves a higher fill-in Dmax in each color record, thus allowing continuous tone scenes and fine line images to be printed with improved sharpness at higher densities.

SUMMARY OF THE INVENTION

An object of the invention is to overcome difficulties of prior silver halide paper when utilized with optical scanning devices at exposures below 50 microseconds.

A further object is to provide improved quality for photographic images by laser or LED scanning devices.

An additional object is to provide silver halide formed images that have improved sharpness at higher density when subjected to laser or LED scanning exposures.

These and other advantages of the invention are generally accomplished by providing a photographic element comprising a layer comprising a cyan dye forming coupler, a layer comprising a magenta dye forming coupler and a layer comprising a yellow dye forming coupler, wherein said layers further comprise silver halide emulsions, said emulsions comprise greater than 95 percent chloride and said element when exposed at less than 50 microseconds per pixel in each color record and at a resolution between 200 and 500 pixels per inch provides after development a maximum gamma between 3.4 and 6.0 in at least one color record layer within a log exposure range not exceeding 1.1.

ADVANTAGEOUS EFFECT OF THE INVENTION

The current invention provides a full color silver halide photographic media on paper support for digital scanning exposures that exhibits less digital fringing at higher density. A method of printing is described that achieves improved sharpness and color reproduction at scanning exposures less than 50 microseconds over a range of printer resolutions.

DETAILED DESCRIPTION OF THE INVENTION

The current invention utilizes emulsions in one or more color records having higher shoulder contrast, significantly reduced high intensity reciprocity failure, and narrower dynamic exposure ranges at less than 50 microsecond exposures. The dynamic exposure range is less than or equal to 1.1 logE for the density limits defined for this invention, thus allowing for higher densities and less digital fringing with scanning exposures, especially those utilizing a Gaussian spot profile. A metric for quantifying the threshold dynamic range for digital fringing is described herein.

In forming color photographic papers meeting the parameters of the invention, high chloride emulsions doped with Group VIII metals are generally used to achieve the needed invention properties. Specific examples of suitable emulsions and coupler combinations are set forth in the examples, but persons skilled in the art could derive other combinations to achieve the aims of the invention. Other photographic elements of the invention could be formed by manipulation of bromide and iodide content in the silver chloride grains, changing the morphology of the grains, i.e. cubic, tabular, or tetrahedral, and blending of different emulsions in a single color record.

Figure 4:
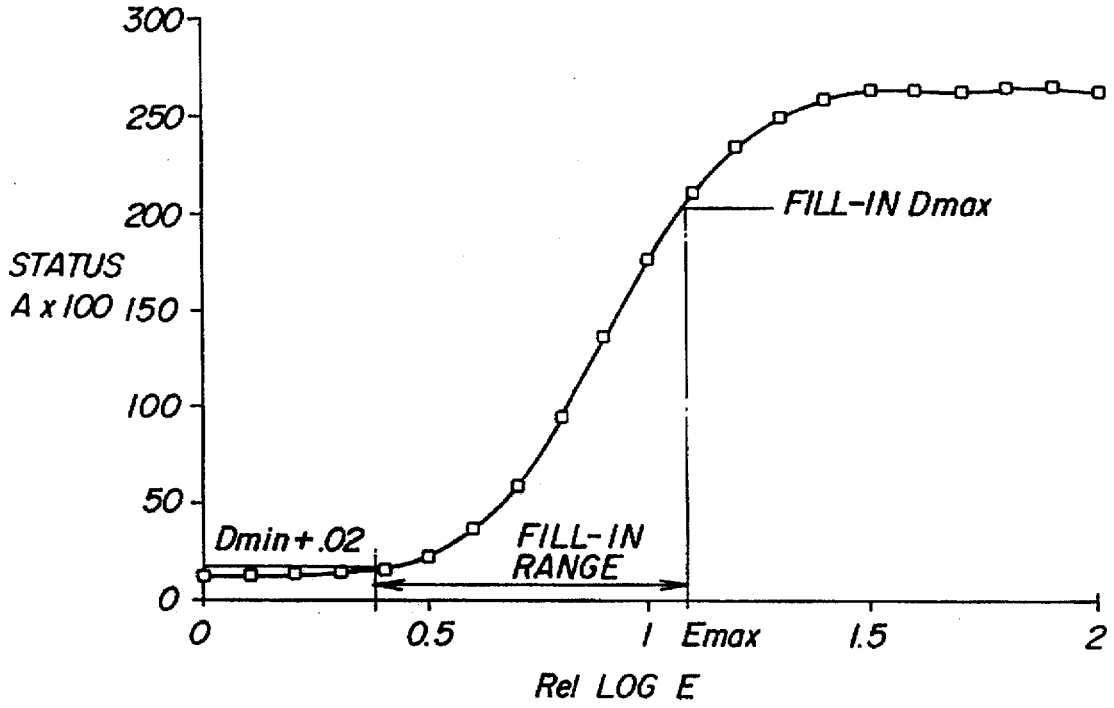
FIG. 4 graphically illustrates "fill-in" density.

A simple test for digital fringing entails scan printing onto a silver halide media a digital step tablet image consisting of blank lines of different pixel widths in each step. As the exposure in the areas surrounding the blank lines increases, the minimum density of the blank lines of the developed image fill in. The minimum density of the blank line is designated the "fill-in density". For a given color record, the log exposure range from Dmin +0.02 to $E_{max}$, the highest exposure where the fill-in density remains below an acceptable limit, is defined in this invention as the "fill-in exposure range", or fill-in range. The Status A density obtained at $E_{max}$ is designated the "fill-in Dmax". See FIG. 4. The invention preferably pertains to a spot profile having a Gaussian energy distribution, typical of laser systems, and spot diameters ranging from 50–100 microns at full width half max. Spot profiles relating to other printing devices such as LEDs, which may have trapezoidal rather than Gaussian energy distribution, are also included by the invention.

According to the present invention, there is provided a negative working silver halide photographic composition coated on paper support for scanning digital exposures, comprising separate red, green, and blue light sensitive layers forming respectively cyan, magenta, and yellow dyes, wherein each layer comprises in part silver halide grains of >95% silver chloride. A preferred photographic composition of this invention, when subjected to Print Method 1 (described below) at 500 ppi (pixels per inch), has the following characteristics:

a fill-in Dmax in the cyan layer, designated $D_c$, that is $\geqq 2.0$;

a fill-in Dmax in the magenta layer, designated $D_m$, that is $\geqq 1.8$, a fill-in Dmax in the yellow layer, designated $D_y$, that is $\geqq 1.6$, and a fill-in exposure range in each color record that is $\leqq 1.1$ log E.

A preferred photographic composition of this invention, when subjected to Print Method 2 (described below) at 250 ppi, has the following characteristics:

a fill-in Dmax in the cyan layer, designated $D_{c'}$, that is $\geqq 1.7$, a fill-in Dmax in the magenta layer, designated $D_{m'}$, that is $\geqq 1.4$, a fill-in Dmax in the yellow layer, designated $D_{y'}$, that is $\geqq 1.3$, and a fill-in exposure range in each color record that is $\leqq 1.1$ log E

Description Of Laser Printer System

The laser exposure device used in defining this invention is a 3 color system having the following specifications:

lasers

| | | |
|---|---|---|
| red | helium-neon | 632.8 nm |
| green | argon ion | 514.5 nm |
| blue | argon ion (multiline) | 476.5 nm |

maximum available power at film plane

| | |
|---|---|
| red | 1600 μW |
| green | 343 μW |
| blue | 24.6 μW |

exposure characteristics and spot profile

| pixel pitch (pixels/in) | beam diameter (FWHM) (microns) | pixel rate (MHz) | exposure time/pixel (nanosec) |
|---|---|---|---|
| 250 | 101.6 | 1.228 | 814 |
| 500 | 50.8 | 2.048 | 488 |

FWHM = full width half max. The circular Gaussian beam profile of the laser is sized at the paper plane to overlap at 50% power level. The FWHM beam diameter is therefore also equal to the pixel pitch.

4000 pixels/line (fast scan direction), 6000 lines per page (slow scan direction).

paper placement—inside surface of a semi-cylindrical drum beam modulation—12 bit acousto-optic modulator (AOM)

line scan—a monogon rotating at 6144 rpm steers beam 90 degrees onto the paper surface at constant radius from axis of rotation.

page scan—a DC servo motor driven lead screw drives the paper carrier assembly that is supported on a linear translation stage.

red, green, and blue channels are written simultaneously, combined in a single "white" light beam after modulation. The "white" beam is focused through one of the four format lenses mounted on a turret assembly located just prior to the monogon.

calibration—look-up table relates 12-bit AOM DAC value to output 8 bit Status A code value.

Print Method 1.

Figure 1:
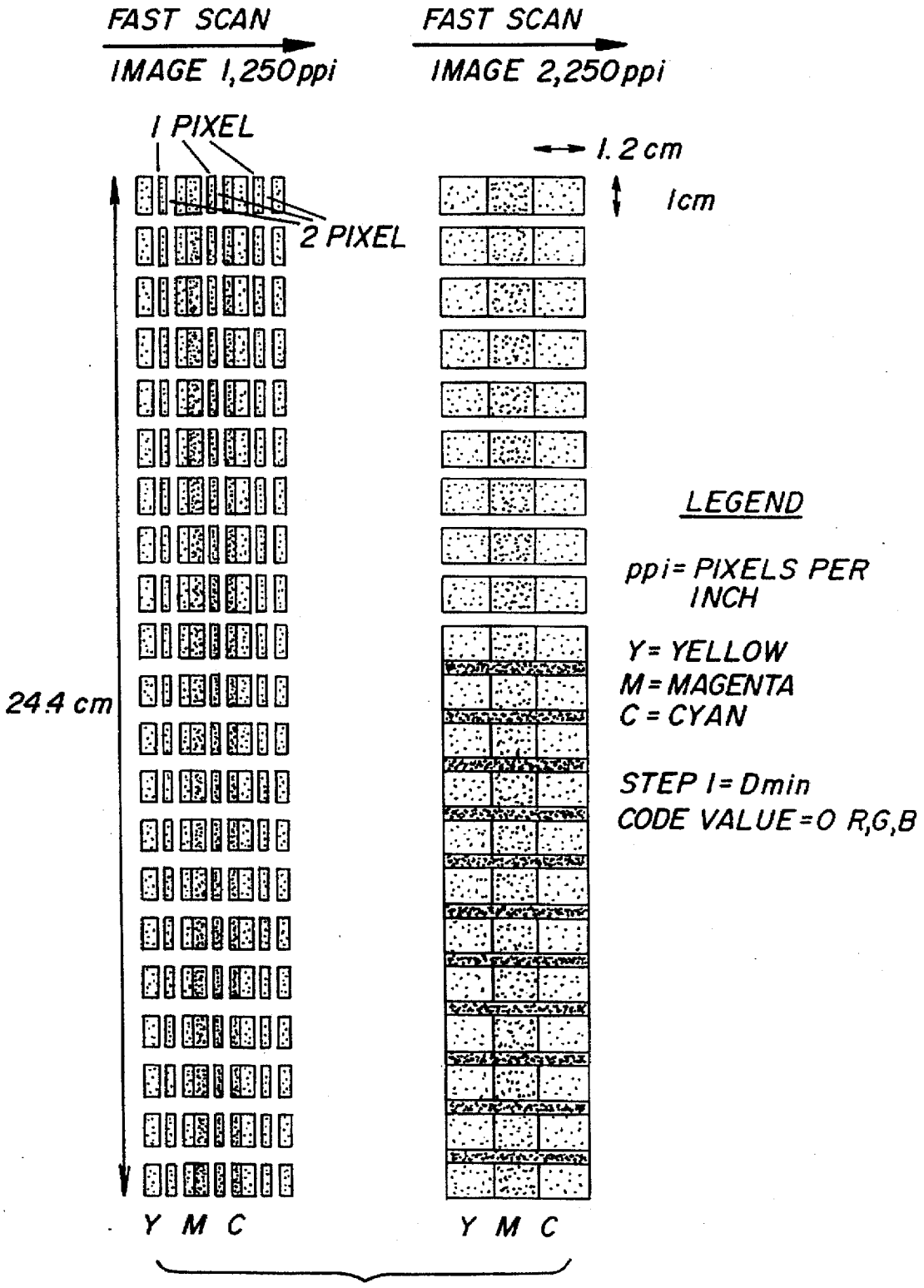
FIG. 1 illustrates the print produced by the test of this invention.

Image 1, detailed in FIG. 1, was produced by submitting a photographic paper to a scanning laser exposure at a resolution of 500 pixels per inch (197 pixels/cm), followed by rapid access (RA4) development. Each line was scanned once (disregarding overlap between lines). Image 1 consists of side-by-side yellow, magenta, cyan, and neutral step tablets (21 steps) having dimensions in the final print specified in FIG. 1. The steps are oriented 90° to the fast scan (line scan) direction. Adjacent steps in each color record are separated by a log exposure difference of 0.10 log E. Image 1 has two blank lines (code value=0), 1 and 2 pixels wide, spaced 400 microns apart and at least 400 microns from the edge of the step of each separation tablet. The blank lines are also oriented 90° to the fast scan direction. Step 1 in each tablet receives zero exposure, corresponding to Dmin in the print. Step 21 receives the maximum exposure. Image 2 in FIG. 1 is a duplicate of Image 1 without the blank lines, each step receiving the same exposure as the corresponding step in Image 1. Those skilled in the art will recognize that construction of the digital files necessary for printing Image 1 and Image 2 can be accomplished with readily available software such as Photoshop (Trademark by Adobe). In FIG. 1 it is also noted: 1) that the fiducial width is 1 mm; 2) that the white fiducials, 1 pixel, and 2 pixel wide blank lines all have code value 0 in the red, green and blue channels, corresponding to Dmin; 3) that the 1 pixel and 2 pixel blank lines are spaced greater than 400 microns apart and are greater than 400 microns from the edge of each step; 4) that adjacent steps differ by 0.1 log exposure units in each tablet, and 5) the black fiducial code values were 255 in each channel, corresponding to Dmax.

Print Method 2.

Images 3 and 4 of FIG. 1 are identical in content and format size to Images 1 and 3 respectively, but are printed at a resolution of 250 pixels per inch.

Densitometry of Images 2 and 4.

Status A densities of each step in Images 2 and 4 were measured with an X-Rite DTP36 autoscanning densitometer. A characteristic H&D curve for each color record was then constructed showing Status A density as a function of relative log exposure.

Gamma at each step X in Image 2 was calculated by dividing the Status A density difference between Step X and Step X–1 by 0.1 (the log exposure difference).

Microdensitometry of Images 1 and 3.

Figure 2:
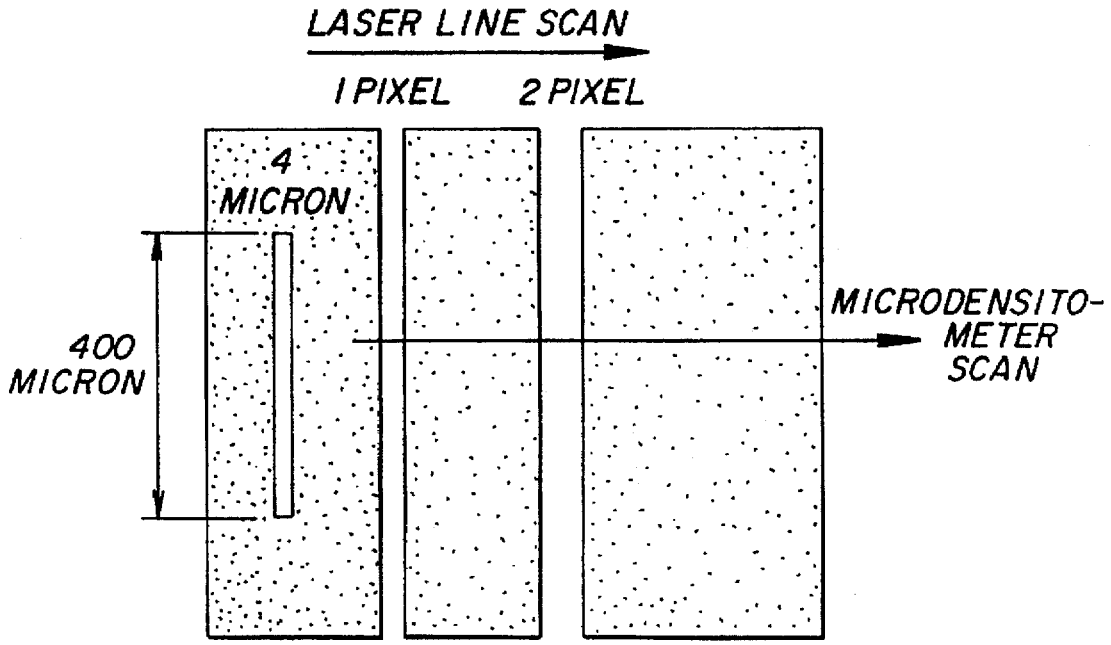
FIG. 2 illustrates the scanning pattern to test the prints of the invention.

Images 1 and 3, obtained by digital laser exposure followed by rapid access development, were scanned using a Perkin-Elmer PDS Microdensitometer Model 1010A. The reflection geometry was 45 degrees and 0 degrees. No filtration was in the optical path, and 0.00 density represents the Dmin of the paper. A 5× objective and 5× ocular made the total magnification of the system 25×. The slit aperture length was 400 microns. Contiguous data was taken every 4 microns beginning approximately 300 microns from the 1 pixel line for a total of 500 data points, or 2000 microns, in each measured step of the cyan, magenta, and yellow tablets. See FIG. 2.

Figure 3:
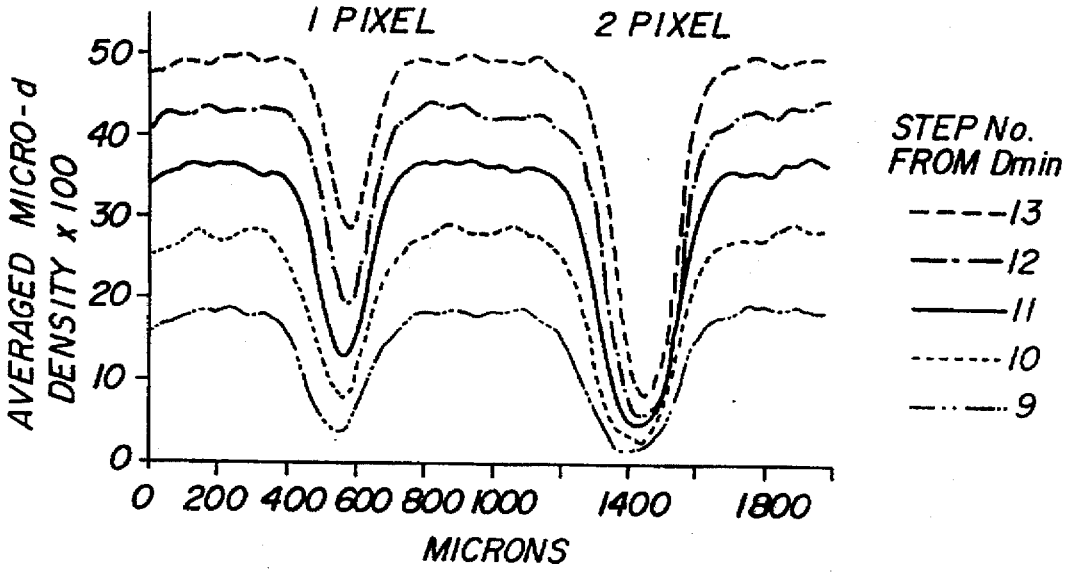
FIG. 3 illustrates the density plot for a test sample.

The coarse readings were smoothed by averaging the densities of 5 readings—a point and its 4 surrounding points—for each point. Ten iterations of this procedure produced the final averaged density values for each of 500 data points. The averaged densities were plotted as a function of distance to produce a profile of the two blank lines in each step of each tablet, as illustrated in FIG. 3, which is an example profile of the 1 & 2 pixel wide blank lines derived from microdensitometry (micro-d) of the target image. The density at the deepest portion of each blank line, the fill-in density, increases with exposure to the surrounding area. An exposure which produced a fill-in density greater than the values listed in Table 1 in the 2 pixel wide line of Image 1 and in the 1 pixel wide line of Image 3 was considered unacceptable.

TABLE 1

| Separation tablet | Highest Acceptable Micro-d Density (×100) ** |
|---|---|
| cyan | 25 |
| magenta | 30 |
| yellow | 20 |

** Corresponding to Point B of Image 1 and Point A of Image 3.

Following the procedures described above for a given photographic paper, there is found some maximum exposure in each color record for which the fill-in density does not exceed the values listed in Table 1. The Status A density corresponding to this maximum exposure, obtained from either Image 2 or Image 4, establishes the fill-in Dmax for that color record at either 500 ppi or 250 ppi resolution. To fall within the scope of this invention the fill-in Dmax in at least color record at 500 ppi must equal or exceed the values listed in Table 2.

TABLE 2

| 500 ppi | |
|---|---|
| Separation tablet | Fill-in Dmax (Status A) |
| cyan | $D_c \geqq 2.0$ |
| magenta | $D_m \geqq 1.8$ |
| yellow | $D_y \geqq 1.6$ |

Furthermore, the fill-in Dmax in at least one color record must equal or exceed the values listed in Table 3 at 250 ppi.

TABLE 3

| 250 ppi | |
|---|---|
| Separation tablet | Fill-in Dmax (Status A) |
| cyan | $D_c \geqq 1.7$ |
| magenta | $D_m \geqq 1.4$ |
| yellow | $D_y \geqq 1.3$ |

The materials of the invention can be used with photographic elements in any of the ways and in any of the combinations known in the art. Typically, the photographic materials are incorporated in a silver halide emulsion and the emulsion coated as a layer on a support to form part of a photographic element. Alternatively, they can be incorporated at a location adjacent to the silver halide emulsion layer where, during development, they will be in reactive association with development products such as oxidized color developing agent. Thus, as used herein, the term "associated" signifies that the compound is in the silver halide emulsion layer or in an adjacent location where, during processing, it is capable of reacting with silver halide development products.

To control the migration of various components, it may be desirable to include a high molecular weight hydrophobe or "ballast" group in the component molecule. Representative ballast groups include substituted or unsubstituted alkyl or aryl groups containing 8 to 40 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arysulfonyl, sulfonamido, and sulfamoyl groups wherein the substituents typically contain 1 to 40 carbon atoms. Such substituents can also be further substituted.

It is understood thoroughout this specification and claims that any reference to a substituent by the identification of a group containing a substitutable hydrogen (e.g. alkyl, amine, aryl, alkoxy, heterocyclic, etc.), unless otherwise specifically stated, shall encompass not only the substituent's unsubstituted form, but also its form substituted with any photographically useful substituents. Usually the substituent will have less than 30 carbon atoms and typically less than 20 carbon atoms. Typical examples of substituents include alkyl, aryl, anilino, acylamino, sulfonamide, alkylthio, arylthio, alkenyl, cyclalkyl, and further to these exemplified are halogen, cycloalkenyl, alkinyl, heterocycle, sulfonyl, sulfinyl, phosphonyl, acyl, carbamoyl, sulfamoyl, cyano, alkoxy, aryloxy, heterocyclic oxy, siloxy, acyloxy, carbamoyloxy, amino, alkylamino, imido, ureido, sulfamoylamino, alkoxycarbonylamino, aryloxycarbonylamino, alkoxycarbonyl, aryloxycarbonyl, heterocyclic thio, spiro compound residues and bridged hydrocarbon compound residues.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

In the following discussion of suitable materials for use in the emulsions and elements that can be used in conjunction with elements of this invention, reference will be made to *Research Disclosure*, December 1989, Item 308119, published by Kenneth Mason Publications, Ltd., Dudley Annex, 12a North Street, Emsworth, Hampshire P010 7DQ, ENGLAND, which will be identified hereafter by the term "*Research Disclosure*." The contents of the *Research Disclosure*, including the patents and publications referenced therein, are incorporated herein by reference, and the Sections hereafter referred to are Sections of the *Research Disclosure*.

The silver halide emulsions employed in the elements of this invention can be either negative-working or positive-working. Suitable emulsions and their preparation as well as methods of chemical and spectral sensitization are described in Sections I through IV. Color materials and development modifiers are described in Sections V and XXI. Vehicles are described in Section IX, and various additives such as brighteners, antifoggants, stabilizers, light absorbing and scattering materials, hardeners, coating aids, plasticizers, lubricants and matting agents are described, for example, in Sections V, VI, VIII, X, XI, XII, and XVI. Manufacturing methods are described in Sections XIV and XV, other layers and supports in Sections XIII and XVII, processing methods and agents in Sections XiX and XX, and exposure alternatives in Section XVIII.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in U.K. Patents and published application Nos. 1,466,728, 1,531,927, 1,533,039, 2,006,755A and 2,017,704A, the disclosures of which are incorporated herein by reference.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

Image dye-forming couplers may be included in the element such as couplers that form cyan dyes upon reaction with oxidized color developing agents which are described in such representative patents and publications as: U.S. Pat. Nos. 2,367,531; 2,423,730; 2,474,293; 2,772,162; 2,895,826; 3,002,836; 3,034,892; 3,041,236; 4,883,746 and "Farbkuppler—Eine Literature Ubersicht," published in Agfa Mitteilungen, Band III, pp. 156–175 (1961). Preferably such couplers are phenols and naphthols that form cyan dyes on reaction with oxidized color developing agent. Even more preferable are the cyan couplers described in, for instance, European Patent Application Nos. 544,322; 556,700; 556,777; 565,096; 570,006; and 574,948.

Typical preferred cyan couplers are represented by the following formulas:

CYAN-1

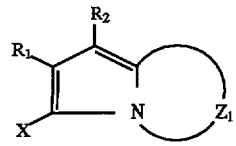

CYAN-2

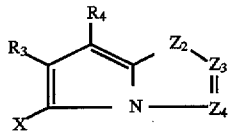

CYAN-3

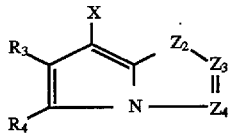

CYAN-4

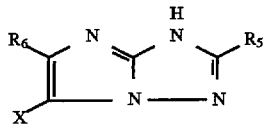

wherein $R_1$, $R_5$ and $R_8$ each represent a hydrogen or a substituent; $R_2$ represents a substituent; $R_3$, $R_4$ and $R_7$ each represent an electron attractive group having a Hammett's substituent constant $sigma_{para}$ of 0.2 or more and the sum of the $sigma_{para}$ values of $R_3$ and $R_4$ is 0.65 or more; $R_6$ represents an electron attractive group having a Hammett's substituent constant $sigma_{para}$ of 0.35 or more; X represents a hydrogen or a coupling-off group; $Z_1$ represents nonmetallic atoms necessary for forming a nitrogen-containing, six-membered, heterocyclic ring which has at least one dissociative group; $Z_2$ represents —C($R_7$)= and —N=; and $Z_3$ and $Z_4$ each represent —C($R^8$)= and —N=.

A dissociative group has an acidic proton, eg. —NH—, —CH(R)—, etc., that preferably has a pKa value of from 3 to 12 in water. Hammett's rule is an empirical rule proposed by L. P. Hammett in 1935 for the purpose of quantitatively discussing the influence of substituents on reactions or equilibria of a benzene derivative having the substituent thereon. This rule has become widely accepted. The values for Hammett's substituent constants can be found or measured as is described in the literature. For example, see C. Hansch and A. J. Leo, *J. Med. Chem.*, 16, 1207 (1973); *J. Med. Chem.*, 20, 304 (1977); and J. A. Dean, *Lange's Handbook of Chemistry*, 12th Ed. (1979) (McGraw-Hill).

Even more preferable are cyan couplers of the following formulas:

CYAN-5

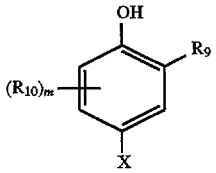

CYAN-6

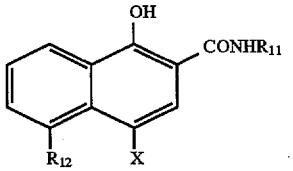

wherein $R_9$ represents a substituent (preferably a carbamoyl, ureido, or carbonamido group); $R_{10}$ represents a substituent preferably individually selected from halogens, alkyl, and carbonamido groups); $R_{11}$ represents ballast substituent; $R_{12}$ represents a hydrogen or a substituent (preferably a carbonamido or sulphonamido group); X represents a hydrogen or a coupling-off group; and m is from 1–3.

Couplers that form magenta dyes upon reaction with oxidized color developing agent are described in such representative patents and publications as: U.S. Pat. Nos. 2,600,788; 2,369,489; 2,343,703; 2,311,082; 2,908,573; 3,062,653; 3,152,896; 3,519,429 and "Farbkuppler—Eine Literature Ubersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents. Especially preferred couplers are 1H-pyrazolo [5,1-c]-1,2,4-triazole and 1H-pyrazolo [1,5-b]-1,2,4-triazole. Examples of 1H-pyrazolo [5,1-c]-1,2,4-triazole couplers are described in U.K. Patent Nos. 1,247,493; 1,252,418; 1,398,979; U.S. Pat. Nos. 4,443,536; 4,514,490; 4,540,654; 4,590,153; 4,665,015; 4,822,730; 4,945,034; 5,017,465; and 5,023,170. Examples of 1H-pyrazolo [1,5-b]-1,2,4-triazoles can be found in European Patent applications 176,804; 177,765; U.S Pat. Nos. 4,659,652; 5,066,575; and 5,250,400.

Typical pyrazolotriazole and pyrazolone couplers are represented by the following formulas:

MAGENTA-1

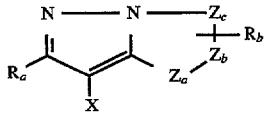

MAGENTA-2

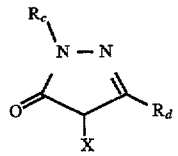

wherein $R_a$ and $R_b$ independently represent H or a substituent; $R_c$ is a substituent (preferably an aryl group); $R_d$ is a substituent (preferably an anilino, acylamino, ureido, carbamoyl, alkoxy, aryloxycarbonyl, alkoxycarbonyl, or N-heterocyclic group); X is hydrogen or a coupling-off group; and $Z_a$, $Z_b$, and $Z_c$ are independently a substituted methine group, =N—, =C—, or —NH—, provided that one of either the $Z_a$—$Z_b$ bond or the $Z_b$—$Z_c$ bond is a double bond and the other is a single bond, and when the $Z_b$—$Z_c$ bond is a carbon-carbon double bond, it may form part of an aromatic ring, and at least one of $Z_a$, $Z_b$, and $Z_c$ represents a methine group connected to the group $R_b$.

Couplers that form yellow dyes upon reaction with oxidized and color developing agent are described in such representative patents and publications as: U.S. Pat. Nos. 2,875,057; 2,407,210; 3,265,506; 2,298,443; 3,048,194; 3,447,928 and "Farbkuppler—Eine Literature Ubersicht," published in Agfa Mitteilungen, Band III, pp. 112–126 (1961). Such couplers are typically open chain ketomethylene compounds. Especially preferred are yellow couplers such as described in, for example, European Patent Application Nos. 482,552; 510,535; 524,540; 543,367; and U.S. Pat. No. 5,238,803.

Typical preferred yellow couplers are represented by the following formulas:

YELLOW-1

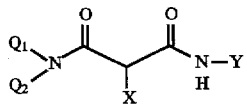

YELLOW-2

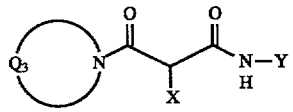

YELLOW-3

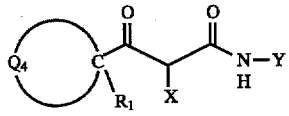

YELLOW-4

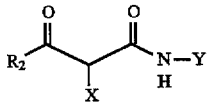

wherein $R_1$, $R_2$, $Q_1$ and $Q_2$ each represent a substituent; X is hydrogen or a coupling-off group; Y represents an aryl group or a heterocyclic group; $Q_3$ represents an organic residue required to form a nitrogen-containing heterocyclic group together with the >N—; and $Q_4$ represents nonmetallic atoms necessary to from a 3- to 5-membered hydrocarbon ring or a 3- to 5-membered heterocyclic ring which contains at least one hetero atom selected from N, O, S, and P in the ring. Particularly preferred is when $Q_1$ and $Q_2$ each represent an alkyl group, an aryl group, or a heterocyclic group, and $R_2$ represents an aryl or tertiary alkyl group.

Typical couplers that may be used with the elements of this invention are shown below.

Couplers
C-1
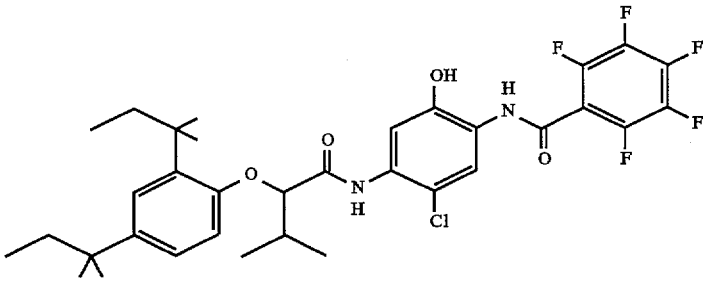
C-2
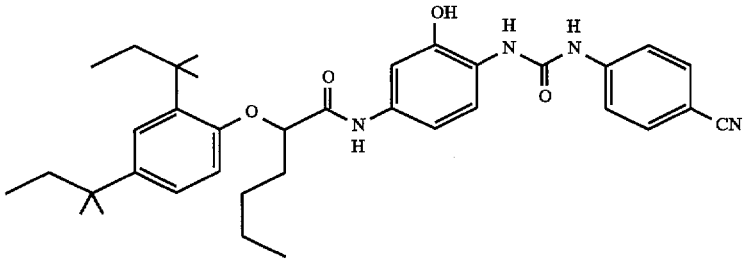
C-3
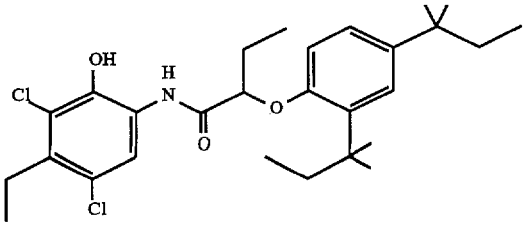
C-4
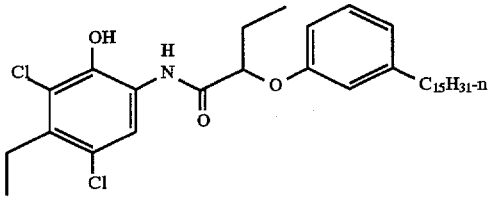
C-5
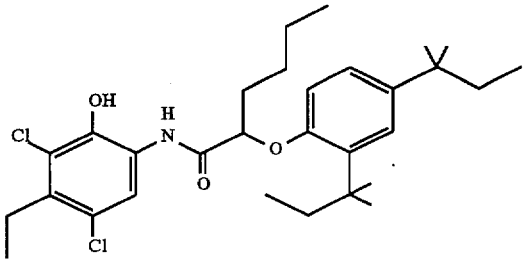
C-6
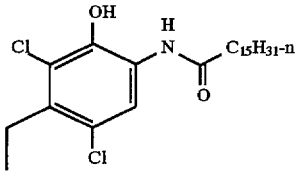

-continued
C-7
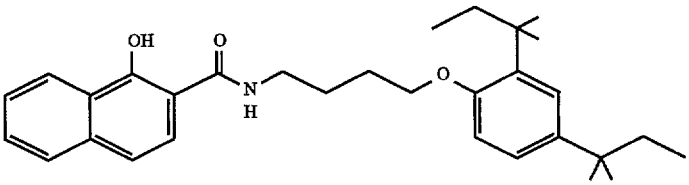
C-8
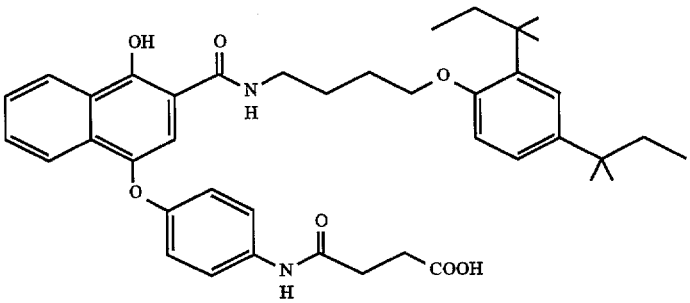
C-9
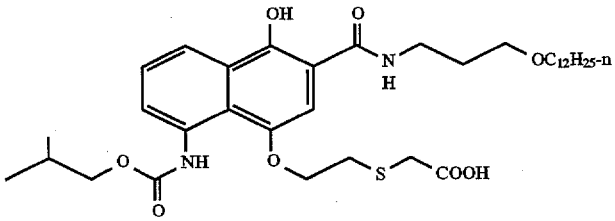
C-10
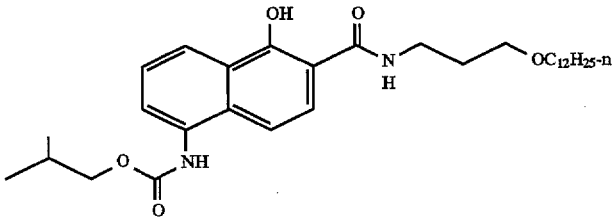
C-11
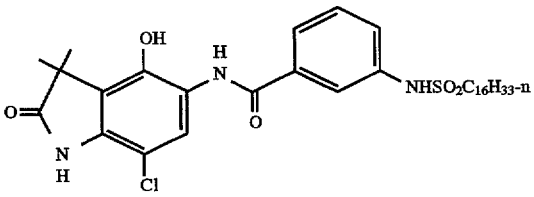
C-12
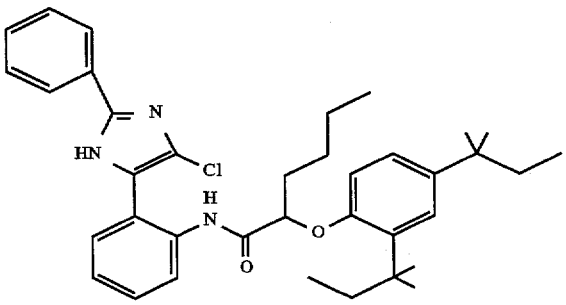

-continued
C-13
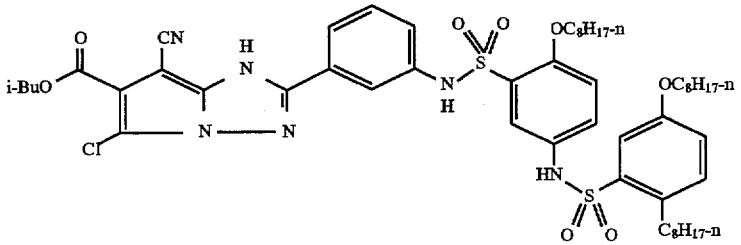
C-14
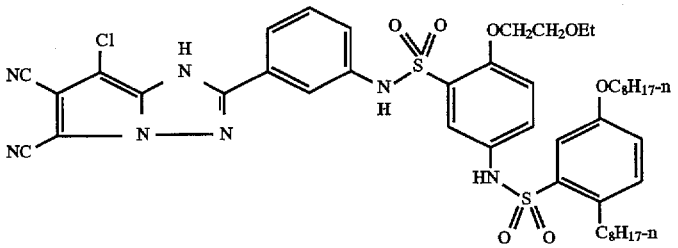
C-15
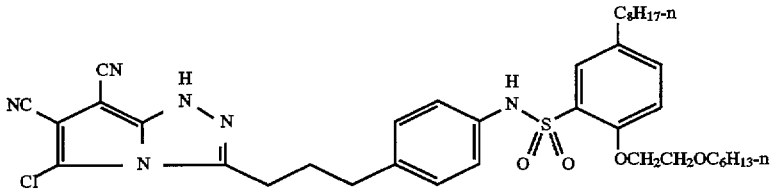
C-16
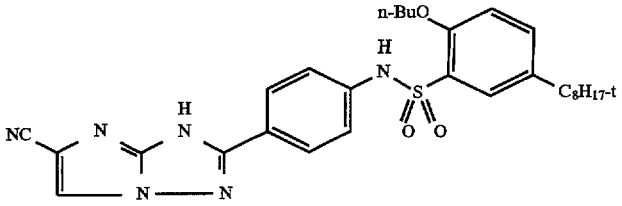
C-17
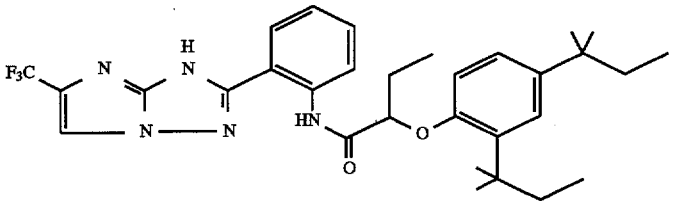
C-18
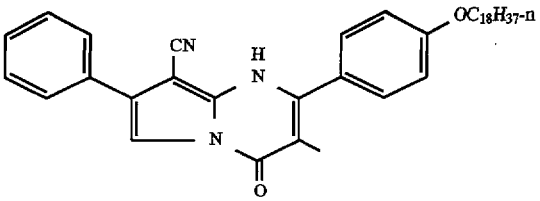
C-19
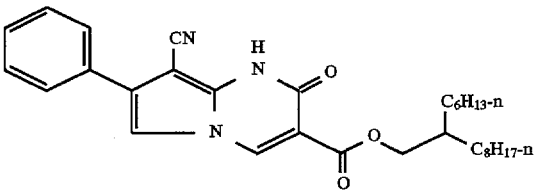

-continued
C-20
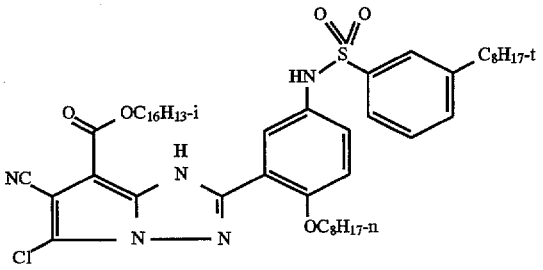
C-21
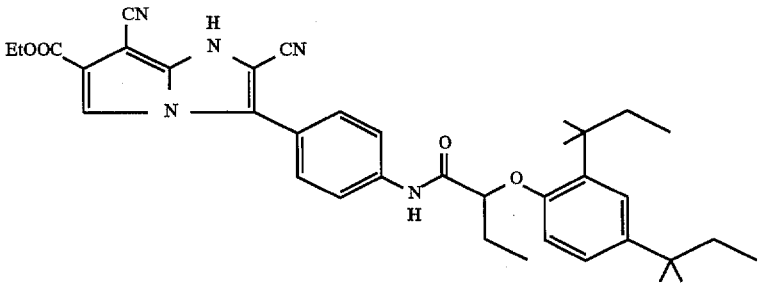
M-1
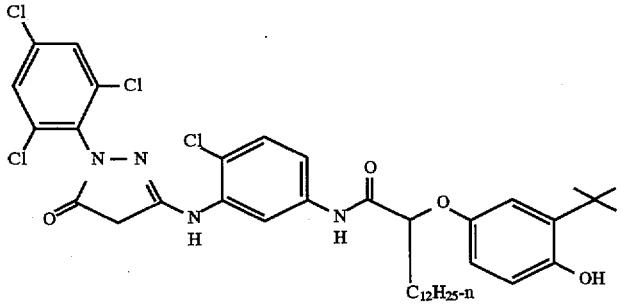
M-2
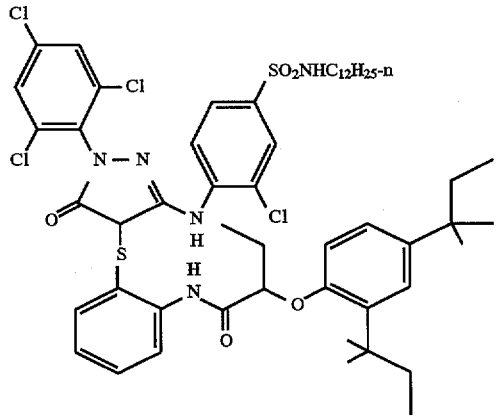

-continued
M-3
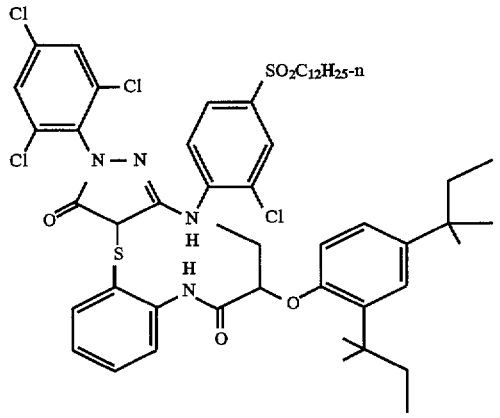
M-4
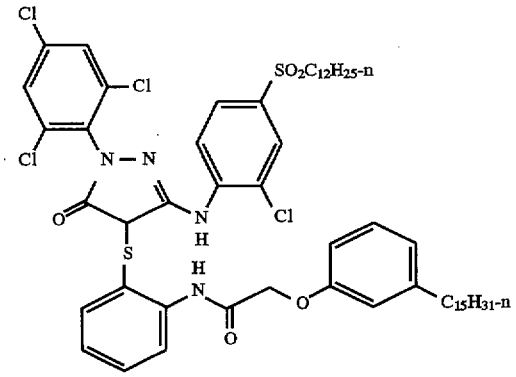
M-5
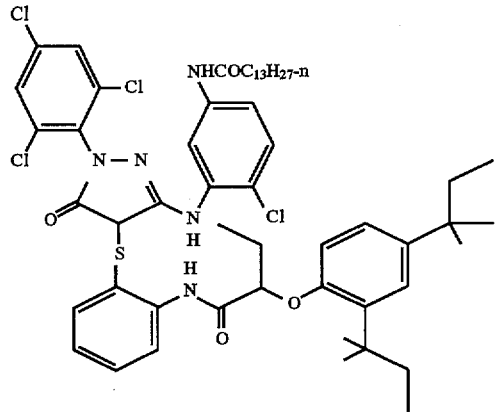
M-6
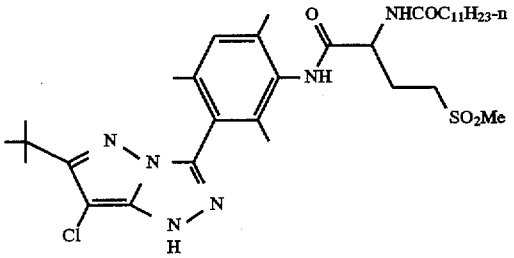
M-7
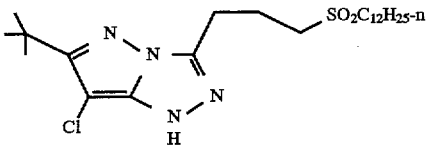

-continued
M-8
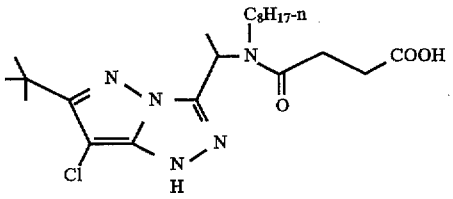
M-9
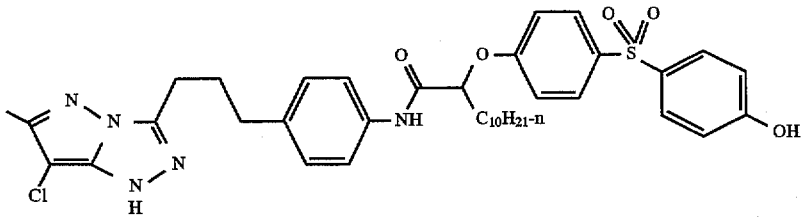
M-10
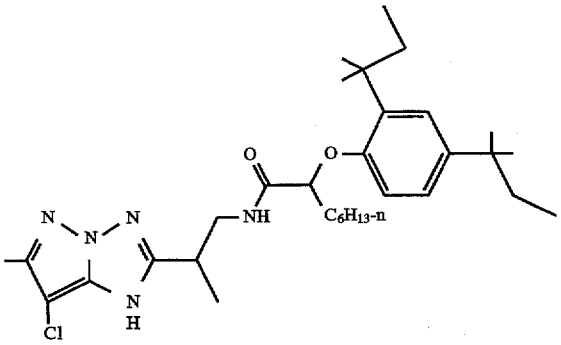
M-11
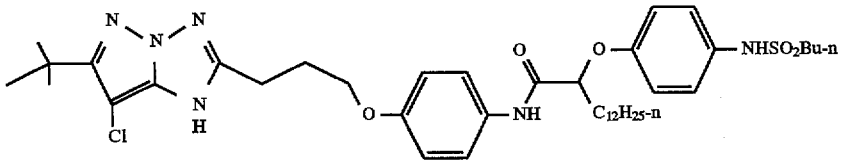
M-12
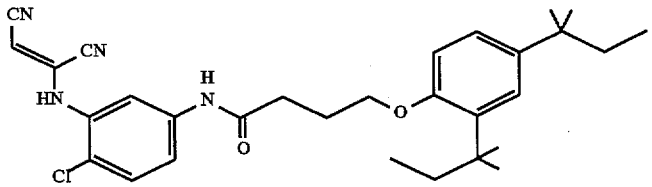
Y-1
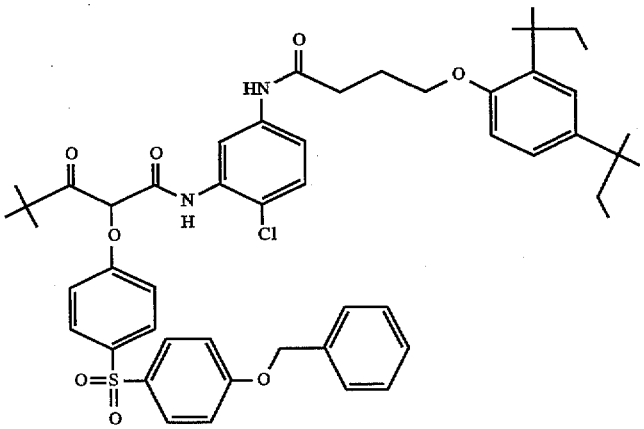

-continued
Y-2
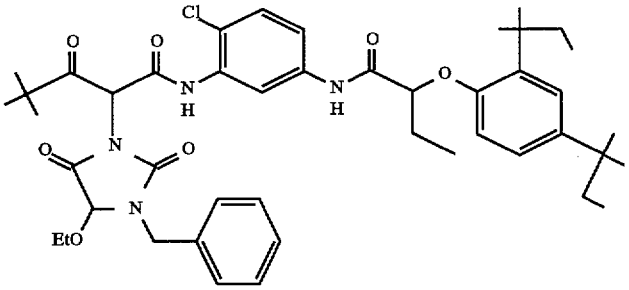
Y-3
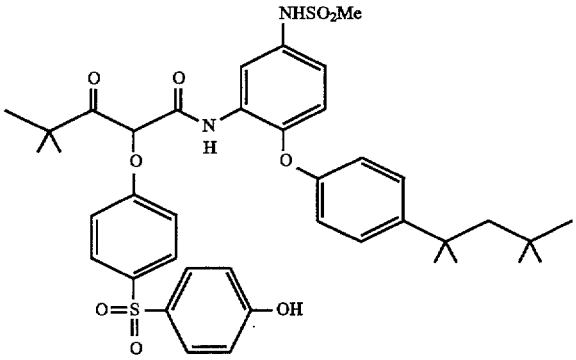
Y-4
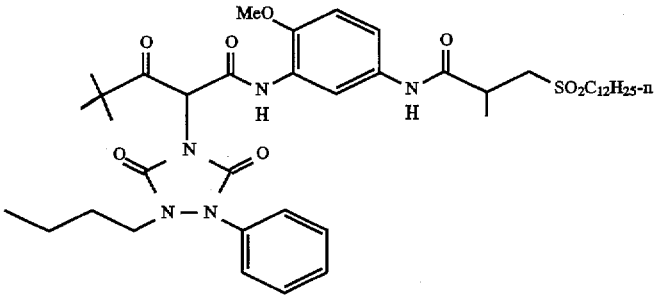
Y-5
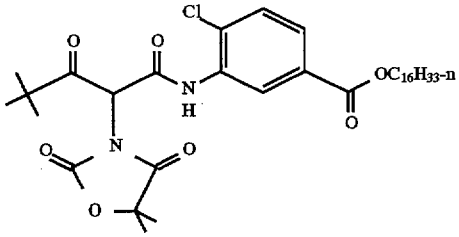
Y-6
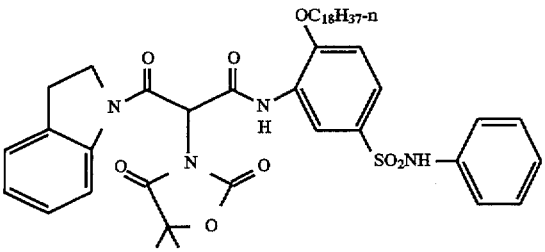

-continued
Y-7
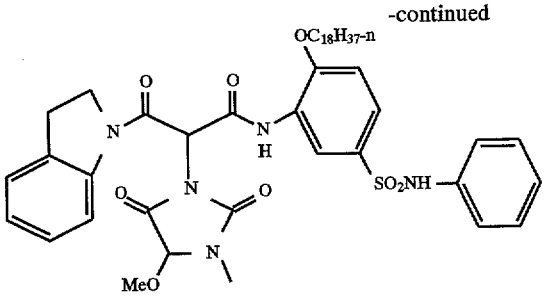
Y-8
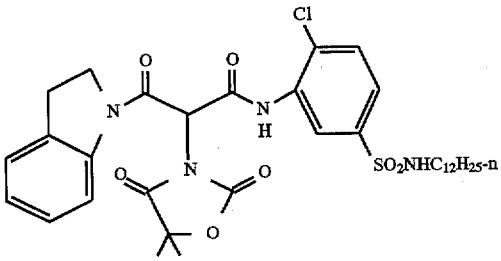
Y-9
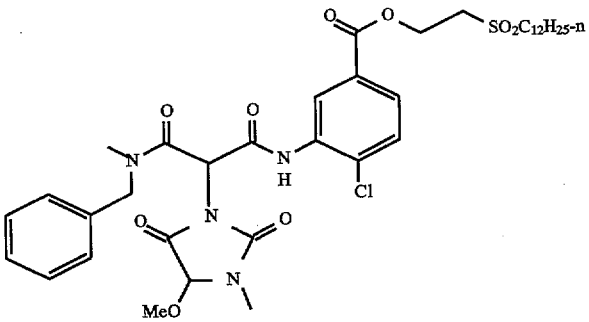
Y-10
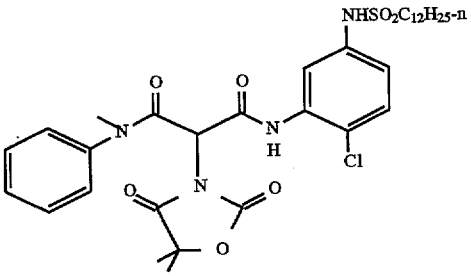
Y-11
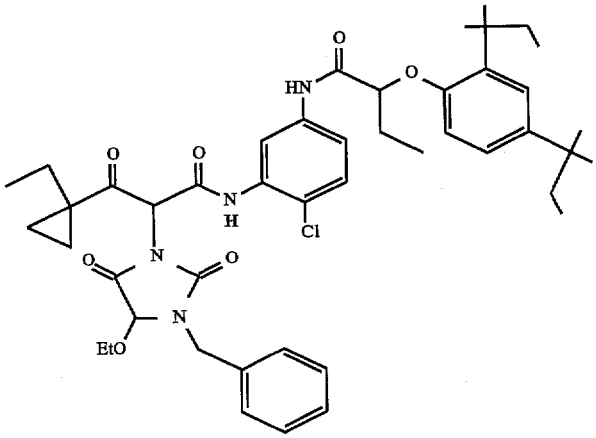
It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may also be used in association with "wrong" colored couplers (e.g. to adjust levels of interlayer correction) and, in color negative applications, with masking couplers such as those described in EP 213,490; Japanese Published Application 58/172,647; U.S. Pat. No. 2,983,608; German Application DE 2,706,117C; U.K. Patent 1,530,272; U.S. Pat. Nos. 4,070,191 and 4,273,861; and German Application DE 2,643,965. The masking couplers may be shifted or blocked.

Suitable hydroquinone color fog inhibitors include, but are not limited to compounds disclosed in EP 69,070; EP 98,241; EP 265,808; Japanese Published Patent Applications 61/233,744; 62/178,250; and 62/178,257. In addition, specifically contemplated are 1,4-benzenedipentanoic acid, 2,5-dihydroxy-DELTA,DELTA,DELTA',DELTA'-tetramethyl-, dihexyl ester; 1,4-Benzenedipentanoic acid, 2-hydroxy-5-methoxy-DELTA,DELTA,DELTA',DELTA'-tetramethyl-, dihexyl ester; and 2,5-dimethoxy-DELTA,DELTA,DELTA', DELTA'-tetramethyl-, dihexyl ester.

Various kinds of discoloration inhibitors can be used in conjunction with elements of this invention. Typical examples of organic discoloration inhibitors include hindered phenols represented by hydroquinones, 6-hydroxychromans, 5-hydroxycoumarans, spirochromans, p-alkoxyphenols and bisphenols, gallic acid derivatives, methylenedioxybenzenes, aminophenols, hindered amines, and ether or ester derivatives obtained by silylation, alkylation or acylation of phenolic hydroxy groups of the above compounds. Also, metal complex salts represented by (bis-salicylaldoximato)nickel complex and (bis-N,N-dialkyldithiocarbamato)nickel complex can be employed as a discoloration inhibitor. Specific examples of the organic discoloration inhibitors are described below. For instance those of hydroquinones are disclosed in U.S. Pat. Nos. 2,360,290, 2,418,613, 2,700,453, 2,701,197, 2,710,801, 2,816,028, 2,728,659, 2,732,300, 2,735,765, 3,982,944 and 4,430,425, and British Patent 1,363,921, and so on; 6-hydroxychromans, 5-hydroxycoumarans, spirochromans are disclosed in U.S. Pat. Nos. 3,432,300, 3,573,050, 3,574,627, 3,698,909 and 3,764,337, and Japanese Published Patent Application 52/152,225, and so on; spiroindanes are disclosed in U.S. Pat. No. 4,360,589; those of p-alkoxyphenols are disclosed in U.S. Pat. No. 2,735,765, British Patent 2,066,975, Japanese Published Patent Applications 59/010,539 and 57/019,765, and so on; hindered phenols are disclosed, for example, in U.S. Pat. Nos. 3,700,455, 4,228,235, Japanese Published Patent Applications 52/072,224 and 52/006,623, and so on; gallic acid derivatives, methylenedioxybenzenes and aminophenols are disclosed in U.S. Pat. Nos. 3,457,079, 4,332,886, and Japanese Published Patent Application 56/021,144, respectively; hindered amines are disclosed in U.S. Pat. Nos. 3,336,135, 4,268,593, British Patents 1,326,889, 1,354,313 and 1,410,846, Japanese Published Patent Applications 51/001,420, 58/114,036, 59/053,846, 59/078,344, and so on; those of ether or ester derivatives of phenolic hydroxy groups are disclosed in U.S. Pat. Nos. 4,155,765, 4,174,220, 4,254,216, 4,279,990, Japanese Published Patent Applications 54/145,530, 55/006,321, 58/105,147, 59/010,539, 57/037,856, 53/003,263 and so on; and those of metal complexes are disclosed in U.S. Pat. Nos. 4,050,938, 4,241,155, 4,346,165, 4,540,653 and 4,906,559.

Stabilizers that can be used in conjunction with elements of the invention include, but are not limited to, the following.

Stabilizers

ST-1

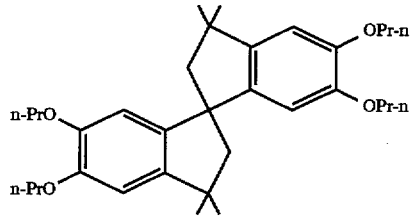

ST-2

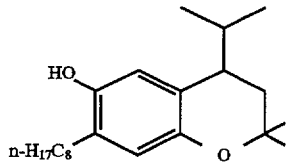

ST-3

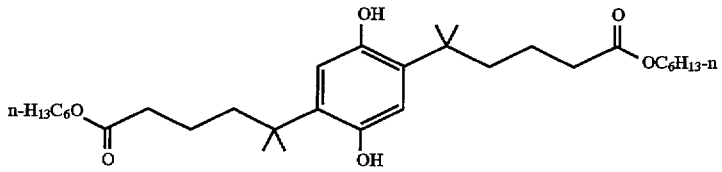

ST-4

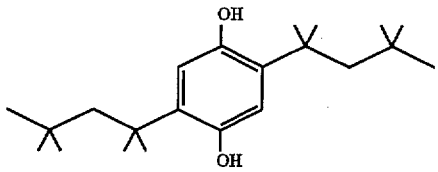

-continued
Stabilizers
ST-5
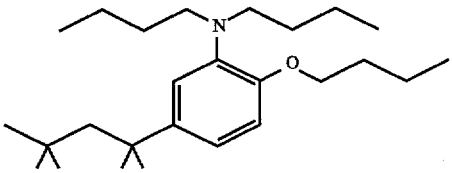
ST-6
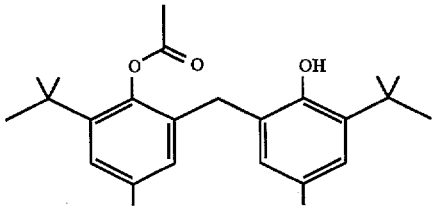
ST-7
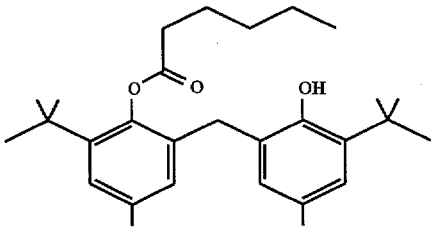
ST-8
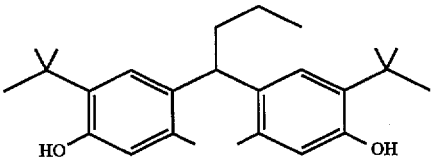
ST-9
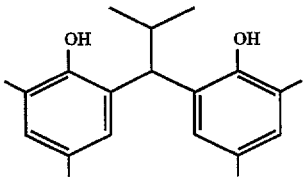
ST-10
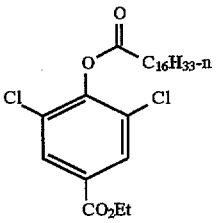
ST-11
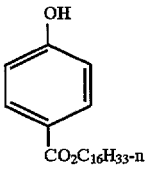
ST-12
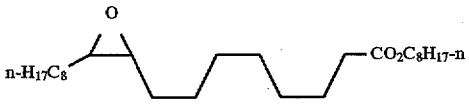

-continued

Stabilizers

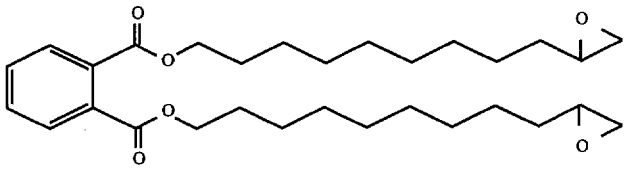

ST-13

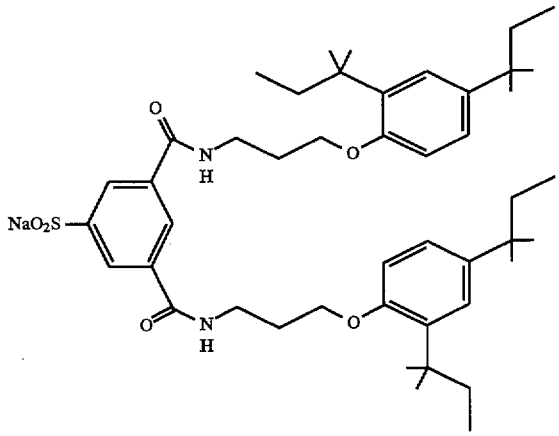

ST-14

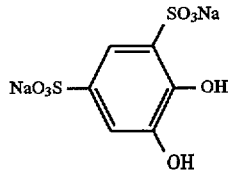

ST-15

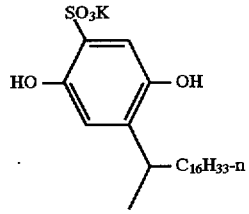

ST-16

The aqueous phase of the dispersions of the invention may comprise a hydrophilic colloid. This may be gelatin or a modified gelatin such as acetylated gelatin, phthalated gelatin, oxidized gelatin, etc. The hydrophilic colloid may be another water-soluble polymer or copolymer including, but not limited to poly(vinyl alcohol), partially hydrolyzed poly(vinylacetate/vinylalcohol), hydroxyethyl cellulose, poly(acrylic acid), poly(1-vinylpyrrolidone), poly(sodium styrene sulfonate), poly(2-acrylamido-2-methane sulfonic acid), and polyacrylamide. Copolymers of these polymers with hydrophobic monomers may also be used.

Oil components may also include high-boiling or permanent solvents. Examples of solvents which may be used include the following.

| Solvents | |
|---|---|
| Dibutyl phthalate | S-1 |
| Tritolyl phosphate | S-2 |
| N,N-Diethyldodecanamide | S-3 |
| Tris(2-ethylhexyl)phosphate | S-4 |
| 2-(2-Butoxyethoxy)ethyl acetate | S-5 |
| 2,5-Di-tert-pentylphenol | S-6 |
| Acetyl tributyl citrate | S-7 |

The dispersions used in photographic elements may also include ultraviolet (UV) stabilizers and so called liquid UV stabilizers such as described in U.S. Pat. Nos. 4,992,358; 4,975,360; and 4,587,346. Examples of UV stabilizers are shown below.

UV Stabilizers (UV Absorbers)
UV-1
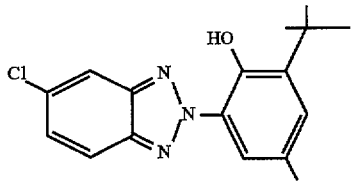
UV-2
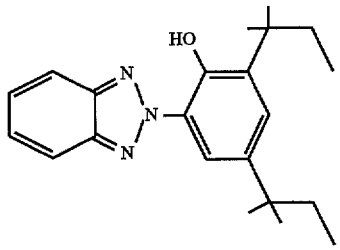
UV-3
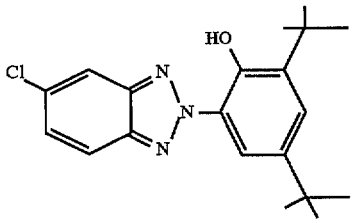
UV-4
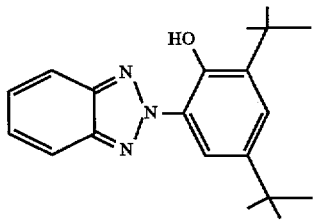
UV-5
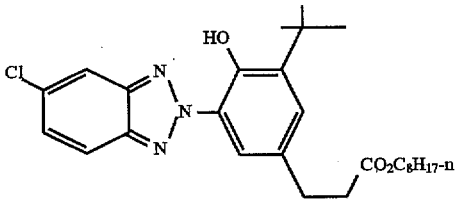
UV-6
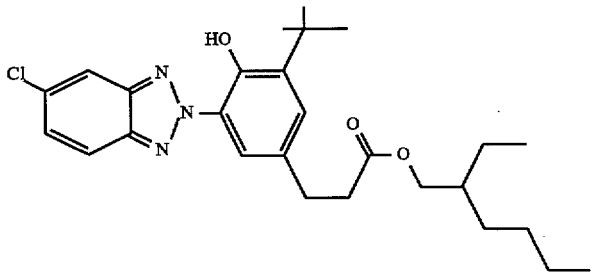
UV-7
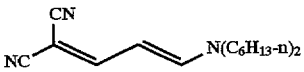
UV-8
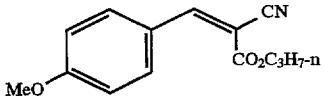

The aqueous phase may include surfactants. Surfactant may be cationic, anionic, zwitterionic or non-ionic. Useful surfactants include, but are not limited to the following.

Surfactants

SF-1

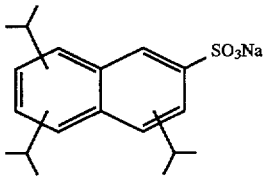

SF-2 $CF_3.(CF_2)_7.SO_3Na$

SF-3 $CH_3.(CH_2)_n.SO_3Na$, n = 12–14

SF-4

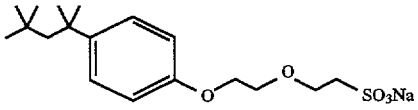

SF-5 $CH_3.(CH_2)_{11}.OSO_3Na$

SF-6

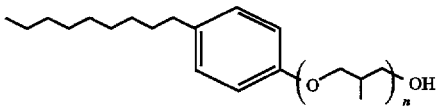

n = ca. 10

SF-7

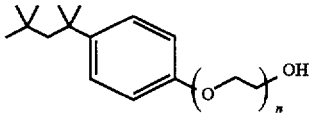

n = ca. 40

SF-8

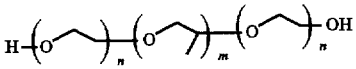

n = ca. 6, m = ca. 22

SF-9

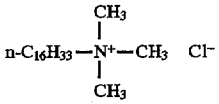

SF-10

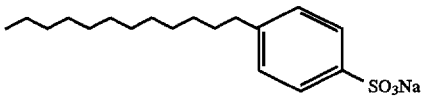

SF-11

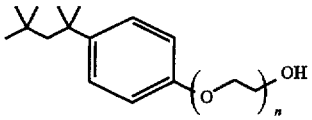

n = ca. 10

Further, it is contemplated to stabilize photographic dispersions prone to particle growth through the use of hydrophobic, photographically inert compounds such as disclosed by Zengerle et al in U.S. application Ser. No. 07/978,104.

Various types of polymeric addenda could be advantageously used in conjunction with elements of the invention. Recent patents, particularly relating to color paper, have described the use of oil-soluble water-insoluble polymers in coupler dispersions to give improved image stability to light, heat and humidity, as well as other advantages, including abrasion resistance, and manufacturability of product. These are described, for instance, in EP 324,476, U.S. Pat. Nos. 4,857,449, 5,006,453, and 5,055,386. In a preferred embodiment, a yellow or cyan image coupler, permanent solvent, and a vinyl polymer with a high glass transition temperature and moderate molecular weight (ca. 40,000) are dissolved together with ethyl acetate, the solution is emulsified in an aqueous solution containing gelatin and surfactant to give fine particles, and the ethyl acetate is removed by evaporation. Preferred polymers include poly(N-t-butylacrylamide) and poly(methyl methacrylate).

Various types of hardeners are useful in conjunction with elements of the invention. In particular, bis(vinylsulphonyl) methane, bis(vinylsulfonyl) methyl ether, 1,2-bis (vinylsulfonyl-acetamido) ethane, 2,4-dichloro-6-hydroxy-s-triazine, triacryloyltriazine, and pyridinium, 1-(4-morpholinylcarbonyl)-4-(2-sulfoethyl)-, inner salt are particularly useful. Also useful are so-called fast acting hardeners as disclosed in U.S. Pat. Nos. 4,418,142, 4,618,573, 4,673,632, 4,863,841, 4,877,724, 5,009,990, 5,236,822.

The invention may be used in combination with photographic elements containing filter dye layers comprising colloidal silver sol or yellow, cyan, and/or magenta filter dyes, either as oil-in-water dispersions, latex dispersions or as solid particle dispersions. Useful examples of absorbing materials are discussed in *Research Disclosure*, December 1989, Item 308119.

The invention also may be used in combination with photographic elements containing light absorbing materials that can increase sharpness and be used to control speed. Examples of useful absorber dyes are described in U.S. Pat. No. 4,877,721, U.S. Pat. No. 5,001,043, U.S. Pat. No. 5,153,108, and U.S. Pat. No. 5,035,985. Solid particle dispersion dyes are described in U.S. Pat. Nos. 4,803,150; 4,855,221; 4,857,446; 4,900,652; 4,900,653; 4,940,654; 4,948,717; 4,948,718; 4,950,586; 4,988,611; 4,994,356; 5,098,820; 5,213,956; 5,260,179; 5,266,454. Useful absorber dyes include, but are not limited to, the following.

Absorber Dyes

AD-1

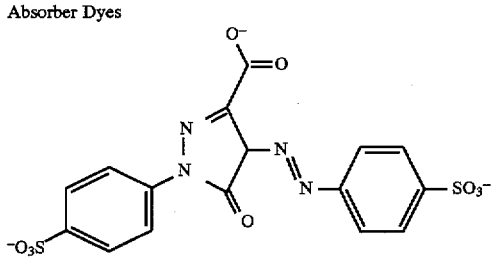

-continued

AD-2

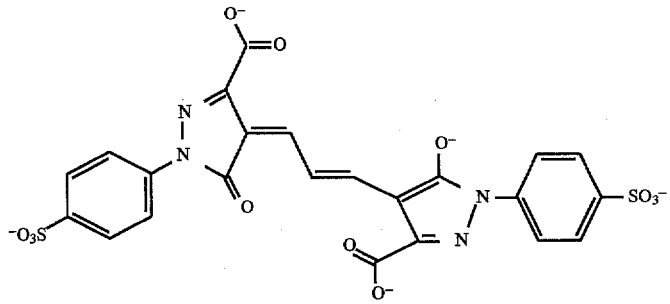

AD-3

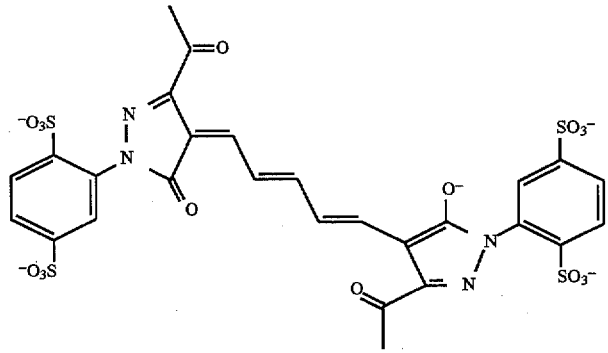

Additionally, the invention may be used with elements containing "smearing" couplers (e.g. as described in U.S. Pat. No. 4,366,237; EP 96,570; U.S. Pat. No. 4,420,556; and U.S. Pat. No. 4,543,323). Also, the compositions may be blocked or coated in protected form as described, for example, in Japanese Application 61/258,249 or U.S. Pat. No. 5,019,492.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Any silver halide combination can be used, such as silver chloride, silver chlorobromide, silver chlorobromoiodide, silver bromide, silver bromoiodide, or silver chloroiodide. Due to the need for rapid processing of the color paper, silver chloride emulsions are preferred. In some instances, silver chloride emulsions containing small amounts of bromide, or iodide, or bromide and iodide are preferred, generally less than 2.0 mole percent of bromide less than 1.0 mole percent of iodide. Bromide or iodide addition when forming the emulsion may come from a soluble halide source such as potassium iodide or sodium bromide or an organic bromide or iodide or an inorganic insoluble halide such as silver bromide or silver iodide.

The shape of the silver halide emulsion grain can be cubic, pseudo-cubic, octahedral, tetradecahedral or tabular. The emulsions may be precipitated in any suitable environment such as a ripening environment, or a reducing environment. Specific references relating to the preparation of emulsions of differing halide ratios and morphologies are Evans U.S. Pat. No. 3,618,622; Atwel U.S. Pat. No. 4,269,927; Wey U.S. Pat. No. 4,414,306; Maskasky U.S. Pat. No. 4,400,463, Maskasky U.S. Pat. No. 4,713,323; Tufano et al U.S. Pat. No. 4,804,621; Takada et al U.S. Pat. No. 4,738,398; Nishikawa et al U.S. Pat. No. 4,952,491; Ishiguro et al U.S. Pat. No. 4,493,508, Hasebe et al U.S. Pat. No. 4,820,624; Maskasky U.S. Pat. No. 5,264,337; and Brust et al EP 534,395.

Emulsion precipitation is conducted in the presence of silver ions, halide ions and in an aqueous dispersing medium including, at least during grain growth, a peptizer. Grain structure and properties can be selected by control of precipitation temperatures, pH and the relative proportions of silver and halide ions in the dispersing medium. To avoid fog, precipitation is customarily conducted on the halide side of the equivalence point (the point at which silver and halide ion activities are equal). Manipulations of these basic parameters are illustrated by the citations including emulsion precipitation descriptions and are further illustrated by Matsuzaka et al U.S. Pat. No. 4,497,895, Yagi et al U.S. Pat. No. 4,728,603, Sugimoto U.S. Pat. No. 4,755,456, Kishita et al U.S. Pat. No. 4,847,190, Joly et al U.S. Pat. No. 5,017,468, Wu U.S. Pat. No. 5,166,045, Shibayama et al EPO 0 328 042, and Kawai EPO 0 531 799.

Reducing agents present in the dispersing medium during precipitation can be employed to increase the sensitivity of the grains, as illustrated by Takada et al U.S. Pat. No. 5,061,614, Takada U.S. Pat. No. 5,079,138 and EPO 0 434 012, Inoue U.S. Pat. No. 5,185,241, Yamashita et al EPO 0 369 491, Ohashi et al EPO 0 371 338, Katsumi EPO 435 270 and 0 435 355 and Shibayama EPO 0 438 791. Chemically sensitized core grains can serve as hosts for the precipitation of shells, as illustrated by Porter et al U.S. Pat. Nos. 3,206,313 and 3,327,322, Evans U.S. Pat. No. 3,761,276, Atwell et al U.S. Pat. No. 4,035,185 and Evans et al U.S. Pat. No. 4,504,570.

Especially useful for use with this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in microns and t is the average thickness in microns of the tabular grains.

The average useful ECD of photographic emulsions can range up to about 10 microns, although in practice emulsion ECD's seldom exceed about 4 microns. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin (t<0.2 micron) tabular grains. To achieve the lowest levels of granularity it is preferred that aim tabular grain projected areas be satisfied with ultrathin (t<0.06 micron) tabular grains. Tabular grain thicknesses typically range down to about 0.02 micron. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micron. Ultrathin tabular grain high chloride emulsions are disclosed by Maskasky in U.S. Pat. No. 5,217,858.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following: *Research Disclosure*, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616. In addition, use of [100] silver chloride emulsions as described in EP 534,395 are specifically contemplated.

Dopants (any grain occlusions other than silver and halide ions) can be employed to modify grain structure and properties. Periods 3–7 ions, including Group VIII metal ions (Fe, Co, Ni and platinum metals (pm) Ru, Rh, Pd, Re, Os, Ir and Pt), Mg, Al, Ca, Sc, Ti, V, Cr, Mn, Cu Zn, Ga, As, Se, Sr, Y, Mo, Zr, Nb, Cd, In, Sn, Sb, Ba, La, W, Au, Hg, Tl, Pb, Bi, Ce and U can be introduced during precipitation. The dopants can be employed (a) to increase the sensitivity of either (a1) direct positive or (a2) negative working emulsions, (b) to reduce (b1) high or (b2) low intensity reciprocity failure, (c) to (c1) increase, (c2) decrease or (c3) reduce the variation of contrast, (d) to reduce pressure sensitivity, (e) to decrease dye desensitization, (f) to increase stability, (g) to reduce minimum density, (h) to increase maximum density, (i) to improve room light handling and (j) to enhance latent image formation in response to shorter wavelength (e.g. X-ray or gamma radiation) exposures. For some uses any polyvalent metal ion (pvmi) is effective. The selection of the host grain and the dopant, including its concentration and, for some uses, its location within the host grain and/or its valence can be varied to achieve aim photographic properties, as illustrated by B. H. Carroll, "Iridium Sensitization: A Literature Review", *Photographic Science and Engineering*, Vol. 24, No. 6 November/December 1980, pp. 265267; Hochstetter U.S. Pat. No. 1,951,933 (Cu); De Witt U.S. Pat. No. 2,628,167; Mueller et al U.S. Pat. No. 2,950,972; Spence et al U.S. Pat. No. 3,687,676 and Gilman et al U.S. Pat. No. 3,761,267; Ohkubu et al U.S. Pat. No. 3,890,154; Iwaosa et al U.S. Pat. No. 3,901,711; Habu et al U.S. Pat. No. 4,173,483; Atwell U.S. Pat. No. 4,269,927; Weyde U.S. Pat. No. 4,413,055; Akimura et al U.S. Pat. No. 4,452,882; Menjo et al U.S. Pat. No. 4,477,561; Habu et a U.S. Pat. No. 4,581,327; Kobuta et al U.S. Pat. No. 4,643,965; Yamashita et al U.S. Pat. No. 4,806,462; Grzeskowiak et al U.S. Pat. No. 4,828,962; Janusonis U.S. Pat. No. 4,835,093; Leubner et al U.S. Pat. No. 4,902,611; Inoue et al U.S. Pat. No. 4,981,780; Kim U.S. Pat. No. 4,997,751; Kuno U.S. Pat. No. 5,057,402; Maekawa et al U.S. Pat. No. 5,134,060; Kawai et al U.S. Pat. No. 5,164,292; Asami U.S. Pat. Nos. 5,166,044 and 5,204,234; Wu U.S. Pat. No. 5,166,045; Yoshida et al U.S. Pat. No. 5,229,263; Marchetti et al U.S. Pat. Nos. 5,264,336 and 5,268,264; Komarita et al EPO 0 244 184; Miyoshi et al EPO 0 488 737 and 0 488 601; Ihama et al EPO 0 368 304; Tashiro EPO 0 405 938; Murakami et al EPO 0 509 674; Budz WO 93/02390; Ohkubo et al U.S. Pat. No. 3,672,901; Yamasue et al U.S. Pat. No. 3,901,713; and Miyoshi et al EPO 0 488 737.

When dopant metals are present during precipitation in the form of coordination complexes, particularly tetra- and hexa-coordination complexes, both the metal ion and the coordination ligands can be occluded within the grains. Coordination ligands, such as halo, aquo, cyano, cyanate, fulminate, thiocyanate, selenocyanate, nitrosyl, thionitrosyl, oxo, carbonyl and ethylenediamine tetraacetic acid (EDTA) ligands have been disclosed and, in some instances, observed to modify emulsion properties, as illustrated by Grzeskowiak U.S. Pat. No. 4,847,191, McDugle et al U.S. Pat. Nos. 4,933,272, 4,981,781, and 5,037,732; Marchetti et al U.S. Pat. No. 4,937,180; Keevert et al U.S. Pat. No. 4,945,035, Hayashi U.S. Pat. No. 5,112,732, Murakami et al EPO 0 509 674, Ohya et al EPO 0 513 738, Janusonis WO 91/10166, Beavers WO 92/16876, Pietsch et al German DD 298,320, and Olm et al U.S. Pat. No. 5,360,712.

Oligomeric coordination complexes can also be employed to modify grain properties, as illustrated by Evans et al U.S. Pat. No. 5,024,931.

Dopants can be added in conjunction with addenda, antifoggants, dye, and stabilizers either during precipitation of the grains or post precipitation, possibly with halide ion addition. These methods may result in dopant deposits near or in a slightly subsurface fashion, possibly with modified emulsion effects, as illustrated by Ihama et al U.S. Pat. No. 4,693,965; Shiba et al U.S. Pat. No. 3,790,390; Habu et a U.S. Pat. No. 4,147,542; Hasebe et al EPO 0 273 430; Ohshima et al EPO 0 312 999; and Ogawa U.S. Statutory Invention Registration H760.

Desensitizing or contrast increasing ions or complexes are typically dopants which function to trap photogenerated holes or electrons by introducing additional energy levels deep within the bandgap of the host material. Examples include, but are not limited to, simple salts and complexes of Groups 8–10 transition metals (e.g. rhodium, iridium, cobalt, ruthenium and osmium), and transition metal complexes containing nitrosyl or thionitrosyl ligands as described by McDugle et al U.S. Pat. No. 4,933,272. Specific examples include $K_3RhCl_6$, $(NH_4)_2Rh(Cl_5)H_2O$, $K_2IrCl_6$, $K_3IrCl_6$, $K_2IrBr_6$, $K_2IrBr_6$, $K_2RuCl_6$, $K_2Ru(NO)Br_5$, $K_2Ru(NS)Br_5$, $K_2OsCl_6$, $Cs_2Os(NO)Cl_5$, and $K_2Os(NS)Cl_5$. Amine, oxalate, and organic ligand complexes of these or other metals as disclosed in Olm et al U.S. Pat. No. 5,360,712 are also specifically contemplated.

It is contemplated to incorporate in the face centered cubic crystal lattice a dopant capable of increasing photographic speed or other photographic features by forming shallow electron traps. When a photon is absorbed by a silver halide grain, an electron (hereinafter referred to as a photoelectron) is promoted from the valence band of the silver halide crystal lattice to its conduction band, creating a hole hereinafter referred to as a photohole) in the valence band. To create a latent image site within the grain, a plurality of photoelectrons produced in a single imagewise exposure must reduce several silver ions in the crystal lattice to form a small cluster of $Ag^{\circ}$ atoms. To the extent that photoelectrons are dissipated by competing mechanisms before the latent image can form, the photographic sensitivity of the silver halide grains is reduced. For example, if the photoelectron returns to the photohole, its energy is dissipated without contributing to latent image formation.

It is contemplated to dope the silver halide to create within it shallow electron traps that contribute to utilizing photoelectrons for latent image formation with greater efficiency. This is achieved by incorporating in the face centered cubic crystal lattice a dopant that exhibits a net valence more positive than the net valence of the ion or ions it displaces in the crystal lattice. For example, in the simplest possible form the dopant can be a polyvalent (+2 to +5) metal ion that displaces silver ion ($Ag^+$) in the crystal lattice structure. The substitution of a divalent cation, for example, for the monovalent $Ag^+$ cation leaves the crystal lattice with a local net positive charge. This lowers the energy of the conduction band locally. The amount by which the local energy of the conduction band is lowered can be estimated by applying the effective mass approximation as described by J. F. Hamilton in the journal *Advances in Physics*, Vol. 37 (1988) p. 395 and *Excitonic Processes in Solids* by M. Ueta, H. Kansaki, K. Kobayshi, Y. Toyozawa and E. Hanamura (1986), published by Springer Verlag, Berlin, p. 359. If a silver chloride crystal lattice structure receives a net positive charge of +1 by doping, the energy of its conduction band is lowered in the vicinity of the dopant by about 0.048 electron volts (eV). For a net positive charge of +2 the shift is about 0.192 eV. For a silver bromide crystal lattice structure a net positive charge of +1 imparted by doping lowers the conduction band energy locally by about 0.026 eV. For a net positive charge of +2 the energy is lowered by about 0.104 eV.

When photoelectrons are generated by the absorption of light, they are attracted by the net positive charge at the dopant site and temporarily held (i.e., bound or trapped) at the dopant site with a binding energy that is equal to the local decrease in the conduction band energy. The dopant that causes the localized bending of the conduction band to a lower energy is referred to as a shallow electron trap because the binding energy holding the photoelectron at the dopant site (trap) is insufficient to hold the electron permanently at the dopant site. Nevertheless, shallow electron trapping sites are useful. For example, a large burst of photoelectrons generated by a high intensity exposure can be held briefly in shallow electron traps to protect them against immediate dissipation while still allowing their efficient migration over a period of time to latent image forming sites.

For a dopant to be useful in forming a shallow electron trap it must satisfy additional criteria beyond simply providing a net valence more positive than the net valence of the ion or ions it displaces in the crystal lattice. When a dopant is incorporated into the silver halide crystal lattice, it creates in the vicinity of the dopant new electron energy levels (orbitals) in addition to those energy levels or orbitals which comprised the silver halide valence and conduction bands. For a dopant to be useful as a shallow electron trap it must satisfy these additional criteria: (1) its highest energy electron occupied molecular orbital (HOMO, also commonly referred to as the frontier orbital) must be filled—e.g. if the orbital will hold two electrons (the maximum possible number), it must contain two electrons and not one and (2) its lowest energy unoccupied molecular orbital (LUMO) must be at a higher energy level than the lowest energy level conduction band of the silver halide crystal lattice. If conditions (1) and/or (2) are not satisfied, there will be a local, dopant-derived orbital in the crystal lattice (either an unfilled HOMO or a LUMO) at a lower energy than the local, dopant-induced conduction band minimum energy, and photoelectrons will preferentially be held at this lower energy site and thus impede the efficient migration of photoelectrons to latent image forming sites.

Metal ions satisfying criteria (1) and (2) are the following: Group 2 metal ions with a valence of +2, Group 3 metal ions with a valence of +3 but excluding the rare earth elements 58–71, which do not satisfy criterion (1), Group 12 metal ions with a valence of +2 (but excluding Hg, which is a strong desensitizer, possibly because of spontaneous reversion to $Hg^+$), Group 13 metal ions with a valence of +3, Group 14 metal ions with a valence of +2 or +4 and Group 15 metal ions with a valence of +3 or +5. Of the metal ions satisfying criteria (1) and (2) those preferred on the basis of practical convenience for incorporation as dopants include the following period 4, 5 and 6 elements: lanthanum, zinc, cadmium, gallium, indium, thallium, germanium, tin, lead and bismuth. Specifically preferred metal ion dopants satisfying criteria (1) and (2) for use in forming shallow electron traps are zinc, cadmium, indium, lead and bismuth. Specific examples of shallow electron trap dopants of these types are provided by DeWitt, Gilman et al, Atwell et al, Weyde et al and Nurakima et al EPO O 590 674 and 0 563 946, each cited above and here incorporated by reference.

Metal ions in Groups 8, 9 and 10 (hereinafter collectively referred to as Group VIII metal ions) that have their frontier orbitals filled, thereby satisfying criterion (1), have also been investigated. These are Group 8 metal ions with a valence of +2, Group 9 metal ions with a valence of +3 and Group 10 metal ions with a valence of +4. It has been observed that these metal ions are incapable of forming efficient shallow electron traps when incorporated as bare metal ion dopants. This is attributed to the LUMO lying at an energy level below the lowest energy level conduction band of the silver halide crystal lattice.

However, coordination complexes of these Group VIII metal ions as well as $Ga^{+3}$ and $In^{+3}$, when employed as dopants, can form efficient shallow electron traps. The requirement of the frontier orbital of the metal ion being filled satisfies criterion (1). For criterion (2) to be satisfied at least one of the ligands forming the coordination complex must be more strongly electron withdrawing than halide (i.e., more electron withdrawing than a fluoride ion, which is the most highly electron withdrawing halide ion).

One common way of assessing electron withdrawing characteristics is by reference to the spectrochemical series of ligands, derived from the absorption spectra of metal ion complexes in solution, referenced in *Inorganic Chemistry: Principles of Structure and Reactivity*, by James E. Huheey, 1972, Harper and Row, New York and in *Absorption Spectra and Chemical Bonding in Complexes* by C. K. Jorgensen, 1962, Pergamon Press, London. From these references the following order of metal ions in the spectrochemical series is apparent: $I^- < Br^- < S^{-2} < \underline{S}CN^- < Cl^- < NO_3^- < F^- < \underline{O}H < ox^{-2} < H_2O < \underline{N}CS^- < CH_3\underline{C}N^- < \underline{N}H_3 <$ en < dipy < phen $< \underline{N}O_2^- <$ phosph $<< \underline{C}N^- < \underline{C}O$. The abbreviations used are as follows: ox=oxalate, dipy=dipyridine, phen=o-phenathroline, and phosph=4-methyl-2,6,7-trioxa-1-phosphabicyclo[2.2.2]octane. The spectrochemical series places the ligands in sequence in their electron withdrawing properties, the first ($I^-$) ligand in the series is the least electron withdrawing and the last (CO) ligand being the most electron withdrawing. The underlining indicates the site of ligand bonding to the polyvalent metal ion. The efficiency of a ligand in raising the LUMO value of the dopant complex increases as the ligand atom bound to the metal changes from Cl to S to O to N to C. Thus, the ligands $\underline{C}N^-$ and $\underline{C}O$ are especially preferred. Other preferred ligands are thiocyanate ($\underline{N}CS^-$), selenocyanate ($\underline{N}CSe^-$), cyanate ($\underline{N}CO^-$), tellurocyanate ($\underline{N}CTe^-$) and azide ($N_3^-$).

Just as the spectrochemical series can be applied to ligands of coordination complexes, it can also be applied to the metal ions. The following spectrochemical series of metal ions is reported in *Absorption Spectra and Chemical Bonding* by C. K. Jorgensen, 1962, Pergamon Press, London: $Mn^{+2} < Ni^{+2} < Co^{+2} < Fe^{+2} < Cr^{+3} @ V^{+3} < Co^{+3} < Mn^{+4} < Mo^{+3} < Rh^{+3} @ Ru^{+3} < Pd^{+4} < Ir^{+3} < Pt^{+4}$. The metal ions in boldface type satisfy frontier orbital requirement (1) above. Although this listing does not contain all the metals ions which are specifically contemplated for use in coordination complexes as dopants, the position of the remaining metals in the spectrochemical series can be identified by noting that an ion's position in the series shifts from $Mn^{+2}$, the least electronegative metal, toward $Pt^{+4}$, the most electronegative metal, as the ion's place in the Periodic Table of Elements increases from period 4 to period 5 to period 6. The series position also shifts in the same direction when the positive charge increases. Thus, $Os^{+3}$, a period 6 ion, is more electronegative than $Pd^{+4}$, the most electronegative period 5 ions but less electronegative than $Pt^{+4}$, the most electronegative period 6 ion.

From the discussion above $Rh^{+3}$, $Ru^{+3}$, $Pd^{+4}$, $Ir^{+3}$, $Os^{+3}$ and $Pt^{+4}$ are clearly the most electronegative metal ions satisfying frontier orbital requirement (1) above and are therefore specifically preferred.

To satisfy the LUMO requirements of criterion (2) above the filled frontier orbital polyvalent metal ions of Group VIII are incorporated in a coordination complex containing ligands, at least one, most preferably at least 3, and optimally at least 4 of which are more electronegative than halide, with any remaining ligand or ligands being a halide ligand. When the metal ion is itself highly electronegative, such $Os^{+3}$, only a single strongly electronegative ligand, such as carbonyl, for example, is required to satisfy LUMO requirements. If the metal ion is itself of relatively low electronegativity, such as $Fe^{+2}$, choosing all of the ligands to be highly electronegative may be required to satisfy LUMO requirements. For example, Fe(II) $(CN)_6$ is a specifically preferred shallow electron trapping dopant. In fact, coordination complexes containing 6 cyano ligands in general represent a convenient, preferred class of shallow electron trapping dopants.

Since $Ga^{+3}$ and $In^{+3}$ are capable of satisfying HOMO and LUMO requirements as bare metal ions, when they are incorporated in coordination complexes they can contain ligands that range in electronegativity from halide ions to any of the more electronegative ligands useful with Group VIII metal ion coordination complexes.

For Group VIII metal ions and ligands of intermediate levels of electronegativity it can be readily determined whether a particular metal coordination complex contains the proper combination of metal and ligand electronegativity to satisfy LUMO requirements and hence act as a shallow electron trap. This can be done by employing electron paramagnetic resonance (EPR) spectroscopy. This analytical technique is widely used as an analytical method and is described in *Electron Spin Resonance: A Comprehensive Treatise on Experimental Techniques*, 2nd Ed., by Charles P. Poole, Jr. (1983) published by John Wiley & Sons, Inc., New York.

Photoelectrons in shallow electron traps give rise to an EPR signal very similar to that observed for photoelectrons in the conduction band energy levels of the silver halide crystal lattice. EPR signals from either shallow trappea electrons or conduction band electrons are referred to as electron EPR signals. Electron EPR signals are commonly characterized by a parameter called the g factor. The method for calculating the g factor of an EPR signal is given by C. P. Poole, cited above. The g factor of the electron EPR signal in the silver halide crystal lattice depends on the type of halide ion(s) in the vicinity of the electron. Thus, as reported by R. S. Eachus, M. T. Olm, R. Janes and M. C. R. Symons in the journal *Physica Status Solidi (b)*, Vol. 152 (1989), pp. 583–592, in a AgCl crystal the g factor of the electron EPR signal is 1.88±0.001 and in AgBr it is 1.49±0.02.

A coordination complex dopant can be identified as useful in forming shallow electron traps if, in the test emulsion set out below, it enhances the magnitude of the electron EPR signal by at least 20 percent compared to the corresponding undoped control emulsion. The undoped control emulsion is a 0.45+0.05 μm edge length AgBr octahedral emulsion precipitated, but not subsequently sensitized, as described for Control 1A of Marchetti et al U.S. Pat. No. 4,937,180. The test emulsion is identically prepared, except that the metal coordination complex in the concentration intended to be used in the emulsion is substituted for $Os(CN_6)^{4-}$ in Example 1B of Marchetti et al.

After precipitation, the test and control emulsions are each prepared for electron EPR signal measurement by first centrifuging the liquid emulsion, removing the supernatant, replacing the supernatant with an equivalent amount of warm distilled water and resuspending the emulsion. This procedure is repeated three times, and, after the final centrifuge step, the resulting powder is air dried. These procedures are performed under safe light conditions.

The EPR test is run by cooling three different samples of each emulsion to 20°, 40° and 60° K, respectively, exposing each sample to the filtered output of a 200 W Hg lamp at a wavelength of 365 nm, and measuring the EPR electron signal during exposure. If, at any of the selected observation temperatures, the intensity of the electron EPR signal is significantly enhanced (i.e., measurably increased above signal noise) in the doped test emulsion sample relative to the undoped control emulsion, the dopant is a shallow electron trap.

As a specific example of a test conducted as described above, when a commonly used shallow electron trapping dopant, $Fe(CN)_6^{4-}$, was added during precipitation at a concentration of $50\times10^{-6}$ dopant ions/silver mole as described above, the electron EPR signal intensity was enhanced by a factor of 8 over undoped control emulsion when examined at 20° K.

Hexacoordination complexes are preferred coordination complexes for use as shallow electron traps. They contain a metal ion and six ligands that displace a silver ion and six adjacent halide ions in the crystal lattice. One or two of the coordination sites can be occupied by neutral ligands, such as carbonyl, aquo or amine ligands, but the remainder of the ligands must be anionic to facilitate efficient incorporation of the coordination complex in the crystal lattice structure. Illustrations of specifically contemplated hexacoordination complexes for are provided by McDugle et al U.S. Pat. No. 5,037,732, Marchetti et al U.S. Pat. Nos. 4,937,180, 5,264,336 and 5,268,264, Keevert et al U.S. Pat. No. 4,945,035, Murakami et al Japanese Patent Application Hei-2[1990]-249588, and Bell U.S. Pat. Nos. 5,252,451 and 5,256,530 the disclosures of which are here incorporated by reference. Careful scientific investigations have revealed Group VIII hexahalo coordination complexes to create deep (desensitizing) electron traps, as illustrated R. S. Eachus, R. E. Graves and M. T. Olm *J. Chem. Phys.*, Vol. 69, pp. 4580–7 (1978) and *Physica Status Solidi A*, Vol. 57, 429–37 (1980).

In a specific, preferred form it is contemplated to employ as a dopant a hexacoordination complex satisfying the formula: $[ML_6]^n$ where M is filled frontier orbital polyvalent metal ion, preferably $Fe^{+2}$, $Ru^{+2}$, $Os^{+2}$, $Co^{+3}$, $Rh^{+3}$, $Ir^{+3}$, $Pd^{+4}$, $Pt^{+4}$; $L_6$ represents six coordination complex ligands which can be independently selected, provided that least four of the ligands are anionic ligands and at least one (preferably at least 3 and optimally at least 4) of the ligands is more electronegative than any halide ligand; and n is −2, −3 or −4.

The following are specific illustrations of dopants capable of providing shallow electron traps:

| | | | |
|---|---|---|---|
| $[Fe(CN)_6]^{-4}$ | SET-1 | $[Ru(CN)_6]^{-4}$ | SET-2 |
| $[Os(CN)_6]^{-4}$ | SET-3 | $[Rh(CN)_6]^{-3}$ | SET-4 |
| $[Ir(CN)_6]^{-3}$ | SET-5 | $[Fe(pyrazine)(CN)_5]^{-4}$ | SET-6 |
| $[RuCl(CN)_5]^{-4}$ | SET-7 | $[OsBr(CN)_5]^{-4}$ | SET-8 |
| $[RhF(CN)_5]^{-3}$ | SET-9 | $[IrBr(CN)_5]^{-3}$ | SET-10 |
| $[FeCO(CN)_5]^{-3}$ | SET-11 | $[RuF_2(CN)_4]^{-4}$ | SET-12 |
| $[OsCl_2(CN)_4]^{-4}$ | SET-13 | $[RhI_2(CN)_4]^{-3}$ | SET-14 |
| $[IrBr_2(CN)_4]^{-3}$ | SET-15 | $[Ru(CN)_5(OCN)]^{-4}$ | SET-16 |
| $[Ru(CN)_5(N_3)]^{-4}$ | SET-17 | $[Os(CN)_5(SCN)]^{-4}$ | SET-18 |
| $[Rh(CN)_5(SeCN)]^{-3}$ | SET-19 | $[Ir(CN)_5(HOH)]^{-2}$ | SET-20 |
| $[Fe(CN)_3Cl_3]^{-3}$ | SET-21 | $[Ru(CO)_2(CN)_4]^{-1}$ | SET-22 |
| $[Os(CN)Cl_5]^{-4}$ | SET-23 | $[Co(CN)_6]^{-3}$ | SET-24 |
| $[Ir(NCS)_6]^{-3}$ | SET-25 | $[In(NCS)_6]^{-3}$ | SET-26 |
| $[Ga(NCS)_6]^{-3}$ | SET-27 | | |

It is additionally contemplated to employ oligomeric coordination complexes to increase speed, as taught by Evans et al U.S. Pat. No. 5,024,93, the disclosure of which is here incorporated by reference.

The dopants are effective in conventional concentrations, where concentrations are based on the total silver, including both the silver in the grains and the silver in epitaxial protrusions. Generally shallow electron trap forming dopants are contemplated to be incorporated in concentrations of at least $1\times10^{-6}$ mole per silver mole up to their solubility limit, typically up to about $5\times10^{-4}$ mole per silver mole. Preferred concentrations are in the range of from about $10^{-5}$ to $10^{-4}$ mole per silver mole. It is, of course, possible to distribute the dopant so that a portion of it is incorporated in grains and the remainder is incorporated in the silver halide epitaxial protrusions.

Dopants (any grain occlusions other than silver and halide ions) can be employed to modify grain structure and properties. Periods 3–7 ions, including Group VIII metal ions (Fe, Co, Ni and platinum metals (pm) Ru, Rh, Pd, Re, Os, Ir and Pt), Mg, Al, Ca, Sc, Ti, V, Cr, Mn, Cu Zn, Ga, As, Se, Sr, Y, Mo, Zr, Nb, Cd, In, Sn, Sb, Ba, La, W, Au, Hg, Tl, Pb, Bi, Ce and U can be introduced during precipitation. The dopants can be employed (a) to increase the sensitivity of either (a1) direct positive or (a2) negative working emulsions, (b) to reduce (b1) high or (b2) low intensity reciprocity failure, (c) to (c1) increase, (c2) decrease or (c3) reduce the variation of contrast, (d) to reduce pressure sensitivity, (e) to decrease dye desensitization, (f) to increase stability, (g) to reduce minimum density, (h) to increase maximum density, (i) to improve room light handling and (j) to enhance latent image formation in response to shorter wavelength (e.g. X-ray or gamma radiation) exposures. For some uses any polyvalent metal ion (pvmi) is effective. The selection of the host grain and the dopant, including its concentration and, for some uses, its location within the host grain and/or its valence can be varied to achieve aim photographic properties, as illustrated by B. H. Carroll, "Iridium Sensitization: A Literature Review", Photographic Science and Engineering, Vol. 24, No. 6 November/December 1980, pp. 265267 (pm, Ir, a, b and d); Hochstetter U.S. Pat. No. 1,951,933 (Cu); De Witt U.S. Pat. No. 2,628,167 (Tl, a, c); Mueller et al U.S. Pat. No. 2,950,972 (Cd, j); Spence et al U.S. Pat. No. 3,687,676 and Gilman et al U.S. Pat. No. 3,761,267 (Pb, Sb, Bi, As, Au, Os, Ir, a); Ohkubu et al U.S. Pat. No. 3,890,154 (VIII, a); Iwaosa et al U.S. Pat. No. 3,901,711 (Cd, Zn, Co, Ni, Tl, U, Th, Ir, Sr, Pb, b1); Habu et al U.S. Pat. No. 4,173,483 (VIII, b1); Atwell U.S. Pat. No. 4,269,927 (Cd, Pb, Cu, Zn, a2); Weyde U.S. Pat. No. 4,413,055 (Cu, Co, Ce, a2); Akimura et al U.S. Pat. No. 4,452,882 (Rh, i); Menjo et al U.S. Pat. No. 4,477,561 (pm, f); Habu et al U.S. Pat. No. 4,581,327 (Rh, c1, f); Kobuta et al U.S. Pat. No. 4,643,965 (VIII, Cd, Pb, f, c2); Yamashita et al U.S. Pat. No. 4,806,462 (pvmi, a2, g); Grzeskowiak et al U.S. Pat. No. 4,4,828,962 (Ru+Ir, b1); Janusonis U.S. Pat. No. 4,835,093 (Re, a1); Leubner et al U.S. Pat. No. 4,902,611 (Ir+4); Inoue et al U.S. Pat. No. 4,981,780 (Mn, Cu, Zn, Cd, Pb, Bi, In, Tl, Zr, La, Cr, Re, VIII, c1, g, h); Kim U.S. Pat. No. 4,997,751 (ir, b2); Kuno U.S. Pat. No. 5,057,402 (Fe, b, f); Maekawa et al U.S. Pat. No. 5,134,060 (Ir, b, c3); Kawai et al U.S. Pat. No. 5,164,292 (Ir+Se, b); Asami U.S. Pat. Nos. 5,166,044 and 5,204,234 (Fe+Ir, a2 b, c1, c3); Wu U.S. Pat. No. 5,166,045 (Se, a2); Yoshida et al U.S. Pat. No. 5,229,263 (Ir+Fe/Re/Ru/Os, a2, b1); Marchetti et al U.S. Pat. Nos. 5,264,336 and 5,268,264 (Fe, g); Komarita et al EPO 0 244 184 (Ir, Cd, Pb, Cu, Zn, Rh, Pd, Pt, Tl, Fe, d); Miyoshi et al EPO 0 488 737 and 0 488 601 (Ir+VIII/Sc/Ti/V/Cr/Mn/Y/Zr/Nb/Mo/La/Ta/W/Re, a2, b, g); Ihama et al EPO 0 368 304 (Pd, a2, g); Tashiro EPO 0 405 938 (Ir, a2, b); Murakami et al EPO 0 509 674 (VIII, Cr, Zn, Mo, Cd, W, Re, Au, a2, b, g); Budz WO 93/02390 (Au, g); Ohkubo et al U.S. Pat. No. 3,672,901 (Fe, a2, c1); Yamasue et al U.S. Pat. No. 3,901,713 (Ir+Rh, f); and Miyoshi et al EPO 0 488 737.

When dopant metals are present during precipitation in the form of coordination complexes, particuiarly tetra- and hexa-coordination complexes, both the metal ion and the coordination ligands can be occluded within the grains. Coordination ligands, such as halo, aquo, cyano, cyanate, fulminate, thiocyanate, selenocyanate, nitrosyl, thionitrosyl, oxo, carbonyl and ethylenediamine tetraacetic acid (EDTA) ligands have been disclosed and, in some instances, observed to modify emulsion properties, as illustrated by Grzeskowiak U.S. Pat. No. 4,847,191, McDugle et al U.S. Pat. Nos. 4,933,272, 4,981,781, and 5,037,732; Marchetti et al U.S. Pat. No. 4,937,180; Keevert et al U.S. Pat. No. 4,945,035, Hayashi U.S. Pat. No. 5,112,732, Murakami et al EPO 0 509 674, Ohya et al EPO 0 513 738, Janusonis WO 91/10166, Beavers WO 92/16876, Pietsch et al German DD 298,320, and Olm et al U.S. application Ser. No. 08/091,148. Oligomeric coordination complexes can also be employed to modify grain properties, as illustrated by Evans et al U.S. Pat. No. 5,024,931.

Dopants can be added in conjunction with addenda, antifoggants, dye, and stabilizers either during precipitation of the grains or post precipitation, possibly with halide ion addition. These methods may result in dopant deposits near or in a slightly subsurface fashion, possibly with modified emulsion effects, as illustrated by Ihama et al U.S. Pat. No. 4,693,965 (Ir, a2); Shiba et al U.S. Pat. No. 3,790,390 (Group VIII, a2, b1); Habu et al U.S. Pat. No. 4,147,542 (Group VIII, a2, b1); Hasebe et al EPO 0 273 430 (Ir, Rh, Pt); Ohshima et al EPO 0 312 999 (Ir, f); and Ogawa U.S. Statutory Invention Registration H760 (Ir, Au, Hg, Tl, Cu, Pb, Pt, Pd, Rh, b, f).

Desensitizing or contrast increasing ions or complexes are typically dopants which function to trap photogenerated holes or electrons by introducing additional energy levels deep within the bandgap of the host material. Examples include, but are not limited to, simple salts and complexes of Groups 8–10 transition metals (e.g., rhodium, iridium, cobalt, ruthenium, and osmium), and transition metal complexes containing nitrosyl or thionitrosyl ligands as described by McDugle et al U.S. Pat. No. 4,933,272. Specific examples include $K_3RhCl_6$, $(NH_4)_2Rh(Cl_5)H_2O$, $K_2IrCl_6$, $K_3IrCl_6$, $K_2IrBr_6$, $K_2IrBr_6$, $K_2RuCl_6$, $K_2Ru(NO)Br_5$, $K_2Ru(NS)Br_5$, $K_2OsCl_6$, $Cs_2Os(NO)Cl_5$, and $K_2Os(NS)Cl_5$. Amine, oxalate, and organic ligand complexes of these or other metals as disclosed in Olm et al U.S. application Ser. No. 08/091,148 are also specifically contemplated.

Shallow electron trapping ions or complexes are dopants which introduce additional net positive charge on a lattice site of the host grain, and which also fail to introduce an additional empty or partially occupied energy lextel deep within the bandgap of the host grain. For the case of a six coordinate transition metal dopant complex, substitution into the host grain involves omission from the crystal structure of a silver ion and six adjacent halide ions (collectively referred to as the seven vacancy ions). The seven vacancy ions exhibit a net charge of −5. A six coordinate dopant complex with a net charge more positive than −5 will introduce a net positive charge onto the local lattice site and can function as a shallow electron trap. The presence of additional positive charge acts as a scattering center through the Coulomb force, thereby altering the kinetics of latent image formation.

Based on electronic structure, common shallow electron trapping ions or complexes can be classified as metal ions or complexes which have (i) a filled valence shell or (ii) a low spin, half-filled d shell with no low-lying empty or partially filled orbitals based on the ligand or the metal due to a large crystal field energy provided by the ligands. Classic examples of class (i) type dopants are divalent metal complex of Group II, e.g., Mg(2+), Pb(2+), Cd(2+), Zn(2+), Hg(2+), and Tl(3+). Some type (ii) dopants include Group VIII complex with strong crystal field ligands such as cyanide and thiocyanate. Examples include, but are not limited to, iron complexes illustrated by Ohkubo U.S. Pat. No. 3,672,901; and rhenium, ruthenium, and osmium complexes disclosed by Keevert U.S. Pat. No. 4,945,035; and iridium and platinum complexes disclosed by Ohshima et al U.S. Pat. No. 5,252,456. Preferred complexes are ammonium and alkali metal salts of low valent cyanide complexes such as $K_4Fe(CN)_6$, $K_4Ru(CN)_6$, $K_4Os(CN)_6$, $K_2Pt(CN)_4$, and $K_3Ir(CN)_6$. Higher oxidation state complexes of this type, such as $K_3Fe(CN)_6$ and $K_3Ru(CN)_6$, can also possess shallow electron trapping characteristics, particularly when any partially filled electronic states which might reside within the bandgap of the host grain exhibit limited interaction with photocharge carriers.

Emulsion addenda that absorb to grain surfaces, such as antifoggants, stabilizers and dyes can also be added to the emulsions during precipitation. Precipitation in the presence of spectral sensitizing dyes is illustrated by Locker U.S. Pat. No. 4,183,756, Locker et al U.S. Pat. No. 4,225,666, Ihama et al U.S. Pat. Nos. 4,683,193 and 4,828,972, Takagi et al U.S. Pat. No. 4,912,017, Ishiguro et al U.S. Pat. No. 4,983,508, Nakayama et al U.S. Pat. No. 4,996,140, Steiger U.S. Pat. No. 5,077,190, Brugger et al U.S. Pat. No. 5,141,845, Metoki et al U.S. Pat. No. 5,153,116, Asami et al EPO 0 287 100 and Tadaaki et al EPO 0 301 508. Non-dye addenda are illustrated by Klotzer et al U.S. Pat. No. 4,705,747, Ogi et al U.S. Pat. No. 4,868,102, Ohya et al U.S. Pat. No. 5,015,563, Bahnmuller et al U.S. Pat. No. 5,045,444, Maeka et al U.S. Pat. No. 5,070,008, and Vandenabeele et al EPO 0 392 092.

Chemical sensitization of the materials in this invention is accomplished by any of a variety of known chemical sensitizers. The emulsions described herein may or may not have other addenda such as sensitizing dyes, supersensitizers, emulsion ripeners, gelatin or halide conversion restrainers present befores during or after the addition of chemical sensitization.

The use of sulfur, sulfur plus gold or gold only sensitizations are very effective sensitizers. Typical gold sensitizers are chloroaurates, aurous dithiosulfate, aqueous colloidal gold sulfide or gold (aurous bis(1,4,5-trimethyl-1,2,4-triazolium-3-thiolate) tetrafluoroborate. Sulfur sensitizers may include thiosulfate, thiocyanate or N,N'-carbobothioyl-bis(N-methylglycine).

The addition of one or more antifoggants as stain reducing agents is also common in silver halide systems. Tetrazaindenes, such as 4-hydroxy-6-methyl(1,3,3a,7)-tetrazaindene, are commonly used as stabilizers. Also useful are mercaptotetrazoles such as 1-phenyl-5-mercaptotetrazole or acetamido-1-phenyl-5-mercaptotetrazole. Arylthiosulfinates, such as tolylthiosulfonate or arylsufinates such as tolylthiosulfinate or esters thereof are also especially useful.

The emulsions can be spectrally sensitized with any of the dyes known to the photographic art, such as the polymethine dye class, which includes the cyanines, merocyanines, complex cyanines and merocyanines, oxonols, hemioxonols, styryls, merostyryls and streptocyanines. In particular, it would be advantageous to select from among the low staining sensitizing dyes disclosed in U.S. application Ser. No. 07/978,589 filed Nov. 19, 1992, and U.S. application Ser. No. 07/978,568 filed Nov. 19, 1992, both granted, and European Patent Application Nos. 93/203,191.7 and 93/203,193.5. Use of low staining sensitizing dyes in a photographic element processed in a developer solution with little or no optical brightening agent (for instance, stilbene compounds such as Blankophor REU) is specifically contemplated. Further, these low staining dyes can be used in combination with other dyes known to the art (*Research Disclosure*, December 1989, Item 308119, Section IV).

Emulsions can be spectrally sensitized with mixtures of two or more sensitizing dyes which form mixed dye aggregates on the surface of the emulsion grain. The use of mixed dye aggregates enables adjustment of the spectral sensitivity of the emulsion to any wavelength between the extremes of the wavelengths of peak sensitivities (lambda-max) of the two or more dyes. This practice is especially valuable if the two or more sensitizing dyes absorb in similar portions of the spectrum (i.e., blue, or green or red and not green plus red or blue plus red or green plus blue). Since the function of the spectral sensitizing dye is to modulate the information recorded in the negative which is recorded as an image dye, positioning the peak spectral sensitivity at or near the lambda-max of the image dye in the color negative produces the optimum preferred response. In addition, the combination of similarly spectrally sensitized emulsions can be in one or more layers.

An important quality characteristic of color paper is color reproduction, which represents how accurately the hues of the original scene are reproduced. Many current color papers use a blue sensitizing dye that gives a maximum sensitivity at about 480 nm. Use of a sensitizing dye that affords a sensitivity maximum that is closer to that of the yellow image dye in film, for instance with a sensitivity maximum of around 450–470 nm, can result in a color paper with improved color reproduction.

If desired, the photographic element can be used in conjunction with an applied magenetic recording layer as described in *Research Disclosure*, November 1992, Item 34390.

It is also contemplated that the concepts of the present invention may be employed to obtain reflection color prints as described in *Research Disclosure*, November 1979, Item 18716, available from Kenneth Mason Publications, Ltd, Dudley Annex, 12a North Street, Emsworth, Hampshire P0101 7DQ, England, incorporated herein by reference. Materials of the invention may be used in combination with a photographic element that contains epoxy solvents (EP 164,961); ballasted chelating agents such as those in U.S. Pat. No. 4,994,359 to reduce sensitivity to polyvalent cations such as calcium; and stain reducing compounds such as described in U.S. Pat. Nos. 5,068,171, 5,096,805, and 5,126,234.

Any suitable base material may be utilized for the color paper of the invention. Typically, base materials are formed of paper or polyester. The paper may be resin-coated. Further, the paper base material may be coated with reflective materials that will make the image appear brighter to the viewer such as polyethylene impregnated with titanium dioxide. In addition, the paper or resins may contain stabilizers, tints, stiffeners or oxygen barrier providing materials such as polyvinyl alcohol (PVA, for example, see EP 553,339). In addition, it may be desired to use the invention in conjunction with a photographic element coated on pH adjusted support as described in U.S. Pat. No. 4,917,994. The particular base material utilized in the invention may be any material conventionally used in silver halide color papers. Such materials are disclosed in *Research Disclosure* 308119, December 1989, page 1009. Additionally materials like polyethylene naphthalate and the materials described in U.S. Pat. Nos. 4,770,931; 4,942,005; and 5,156,905 may be used.

The color paper of the invention may use any conventional peptizer material. A typical material utilized in color paper as a peptizer and carrier is gelatin. Such gelatin may be any of the conventional utilized gelatins for color paper. Preferred are the ossein gelatins. The color papers of the invention further may contain materials such as typically utilized in color papers including biostats, such as described in U.S. Pat. No. 4,490,462, fungicides, stabilizers, inter layers, overcoat protective layers.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. Where applicable, the element may be processed in accordance with color print processes, such as the RA-4 process of Eastman Kodak Company as described in the British Journal of Photography Annual of 1988, pages 198–199.

In these color photographic systems, the color-forming coupler is incorporated in the light-sensitive photographic emulsion layer so that during development, it is available in the emulsion layer to react with the color developing agent that is oxidized by silver image development. When the dye image formed is to be used in situ, couplers are selected which form non-diffusing dyes. For image-transfer color processes, couplers are used which will produce diffusible dyes capable of being mordanted or fixed in the receiving sheet. The color photographic systems described can also be used to produce black-and-white images from non-diffusing couplers as described by Edwards et al in International Publication No. WO 93/012465.

Photographic color light-sensitive materials often utilize silver halide emulsions where the halide, for example chloride, bromide and iodide, is present as a mixture or combination of at least two halides. The combinations significantly influence the performance characteristics of the silver halide emulsion. As explained in Atwell, U.S. Pat. No. 4,269,927, issued May 26, 1981, silver halide with a high chloride content, that is, light-sensitive materials in which the silver halide grains are at least 80 mole percent silver chloride, possesses a number of highly advantageous characteristics. For example, silver chloride possesses less native sensitivity in the visible region of the spectrum than silver bromide, thereby permitting yellow filter layers to be omitted from multicolor photographic light-sensitive materials. However, if desired, the use of yellow filter layers should not be excluded from consideration for a light sensitive material. Furthermore, high chloride silver halides are more soluble than high bromide silver halide, thereby permitting development to be achieved in shorter times. Furthermore, the release of chloride into the developing solution has less restraining action on development compared to bromide and this allows developing solutions to be utilized in a manner that reduces the amount of waste developing solution.

Processing a silver halide color photographic light-sensitive material is basically composed of two steps of 1). color development and 2). desilvering. The desilvering stage comprises a bleaching step to change the developed silver back to an ionic-silver state and a fixing step to remove the ionic silver from the light-sensitive material. The bleaching and fixing steps can be combined into a monobath bleach-fix step that can be used alone or in combination with the bleaching and the fixing step. If necessary, additional processing steps may be added, such as a washing step, a stopping step, a stabilizing step and a pretreatment step to accelerate development.

In color development, silver halide that has been exposed to light is reduced to silver, and at the same time, the oxidized aromatic primary amine color developing agent is consumed by the above mentioned reaction to form image dyes. In this process halide ions from the silver halide grains are dissolved into the developer, where they will accumulate. In addition the color developing agent is consumed by the afore-mentioned reaction of the oxidized color developing agent with the coupler. Furthermore, other components in the color developer will also be consumed and the concentration will gradually be lowered as additional development occurs. In a batch-processing method, the performance of the developer solution will eventually be degraded as a result of the halide ion build-up and the consumption of developer components. Therefore, in a development method that continuously processes a large amount of a silver halide photographic light-sensitive material, for example by automatic-developing processors, in order to avoid a change in the finished photographic characteristics caused by the change in the concentrations of the components, some means is required to keep the concentrations of the components of the color developer within certain ranges.

For instance, a developer solution in a processor tank can be maintained at a 'steady-state equilibrium concentration' by the use of another solution that is called the replenisher solution. By metering the replenisher solution into the tank at a rate proportional to the amount of the photographic light-sensitive material being developed, components can be maintained at an equilibrium within a concentration range that will give good performance. For the components that are consumed, such as the developing agents and preservatives, the replenisher solution is prepared with the component at a concentration higher than the tank concentration. In some cases a material will leave the emulsions layers that will have an effect of restraining development, and will be present at a lower concentration in the replenisher or not present at all. In other cases a material may be contained in a replenisher in order to remove the influence of a materials that will wash out of the photographic light-sensitive material. Further, in other cases, for example, the alkali, or the concentration of a chelating agent where there may be no consumption, the component in the replenisher is the same or similar concentration as in the processor tank. Typically the replenisher has a higher pH to account for the acid that is released during development and coupling reactions so that the tank pH can be maintained at an optimum value.

Similarly, replenishers are also designed for the secondary bleach, fixer and stabilizer solutions. In addition to additions for components that are consumed, components are added to compensate for the dilution of the tank which occurs when the previous solution is carried into the tank by the photographic light-sensitive material.

The following processing steps may be included in the preferable processing steps carried out in the method in which a processing solution is applied:

1) Color developing→bleach-fixing→washing/stabilizing;
2) Color developing→bleaching→fixing→washing/stabilizing;
3) Color developing→bleaching→bleach-fixing→washing/stabilizing;
4). Color developing→stopping→washing→bleaching→washing→fixing→washing/stabilizing;
5) Color developing→bleach-fixing→fixing→washing/stabilizing;
6) Color developing→bleaching→bleach-fixing→fixing→washing/stabilizing.

Among the processing steps indicated above, the steps 1), 2), 3), and 4) are preferably applied. Additionally, each of the steps indicated can be used with multistage applications as described in Hahm, U.S. Pat. No. 4,719,173, with co-current, counter-current, and contraco arrangements for replenishment and operation of the multistage processor.

The color developing solution may contain aromatic primary amine color developing agents, which are well known and widely used in a variety of color photographic processes. Preferred examples are p-phenylenediamine derivatives. They are usually added to the formulation in a salt form, such as the hydrochloride, sulfate, sulfite, p-toluenesulfonate, as the salt form is more stable and has a higher aqueous solubility than the free amine. Among the salts listed the p-toluenesulfonate is rather useful from the viewpoint of making a color developing agent highly concentrated. Representative examples are given below, but they are not meant to limit what could be used with the present invention:

4-amino-3-methyl-N-ethyl-N-(beta-hydroxyethyl)aniline sulfate, 4-amino-3-methyl-N-ethyl-N-(beta-(methanesulfonamido) ethyl)aniline sesquisulfate hydrate, 4-amino-N,N-diethylaniline hydrochloride, 4-amino-3-methyl-N,N-diethylaniline hydrochloride, 4-amino-3-beta-(methanesulfonamido)ethyl-N,N-diethylaniline hydrochloride and 4-amino-N-ethyl-N-(2-methoxyethyl)-m-toluidine di-p-toluene sulfonic acid.

Among the above-mentioned color developing agents, the first two may preferably be used. There may be some instances where the above mentioned color developing agents may be used in combination so that they meet the purposes of the application.

The color developing agent is generally employed in concentrations of from 0.0002 to 0.2 mole per liter of developing solution and more preferably from about 0.001 to 0.05 mole per liter of developing solution.

The developing solution should also contain chloride ions in the range 0.006 to 0.33 mole per liter, preferably 0.02 to 0.16 moles per liter and bromide ions in the range of zero to 0.001 mole per liter, preferably $2\times10^{-5}$ to $5\times10^{-4}$ mole per liter. The chloride ions and bromide ions may be added directly to the developer or they may be allowed to dissolve out from the photographic material in the developer and may be supplied from the emulsion or a source other than the emulsion.

If chloride is added directly to the color developer, the chloride-ion-supplying salt can be (although not limited to) sodium chloride, potassium chloride, ammonium chloride, lithium chloride, magnesium chloride, manganese chloride, and calcium chloride, with sodium chloride and potassium chloride preferred.

If bromide is added directly to the color developer, the bromide-ion-supplying salt can be (although not limited to) sodium bromide, potassium bromide, ammonium bromide, lithium bromide, calcium bromide, and manganese bromide, with sodium bromide and potassium bromide preferred.

The chloride-ions and bromide-ions may be supplied as a counter ion for another component of the developer, for example the counter ion for a stain reducing agent.

Preferably, the pH of the color developer is in the range of 9 to 12, more preferably 9.6 to 11.0 and it can contain other known components of a conventional developing solution.

To maintain the above-mentioned pH, it is preferable to use various buffer agents. Examples of buffer agents that can be mentioned include sodium carbonate, potassium carbonate, sodium bicarbonated potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate) and potassium 5-sulfo-2-hydroxybenzoate (potassium 5-sulfosalicylate). Preferably the amount of buffer agent to be added is 0.1 mole per liter to 0.4 mole per liter.

Additional components of the developer include preservatives to protect the color developing agent from decomposition. The 'preservative' is characterized as a compound that generally can reduce the rate of decomposition of the color developing agent. When it is added to the processing solution for the color photographic material it prevents the oxidation of the color developing agent caused by oxygen in the air. It is preferable that the developer used in conjunction with the present invention contain an organic preservative. Particular examples include hydroxylamine derivatives (but excluding hydroxylamine, as described later), hydrazines, hydrazides, hydroxamic acids, phenols, aminoketones, sacharides, monoamines, diamines, polyamines, quaternary ammonium salts, nitroxy radicals, alcohols, oximes, diamide compounds, and condensed ring-type amines.

For the preferable organic preservatives mentioned above, typical compounds are mentioned below. It is desirable that the amount of the compounds mentioned below be added to the developer solution at a concentration of 0.005 to 0.5 mole per liter, and preferably 0.025 to 0.1 mole per liter.

As hydroxylamine derivatives, the following are preferable:

Fromula (I)

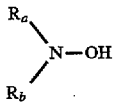

where $R_a$ and $R_b$ each represent a hydrogen atom, a substituted or unsubstituted alkyl group, a substituted or unsubstituted alkenyl group, a substituted or unsubstituted aryl group, a substituted or unsubstituted heteroaromatic group, they do not represent hydrogen atoms at the same time, and they may bond together to form a heterocyclic ring with the nitrogen atom. The ring structure of the heterocyclic ring is a 5–6 member ring, it is made up of carbon atoms, oxygen atoms, nitrogen atoms, sulfur atoms, etc. and it may be saturated or unsaturated.

It is preferable that $R_a$ and $R_b$ each represent an alkyl group or an alkenyl group having 1 to 5 carbon atoms. As nitrogen containing heterocyclic rings formed by bonding $R_a$ and $R_b$ together examples are a piperidyl group, a pyrolidyl group, an N-alkylpiperazyl group, a morpholyl group, an indolinyl group, and a benzotriazole group.

Preferable substituents of $R_a$ and $R_b$ are a hydroxyl group, an alkoxy group, an alkylsulfonyl group, an arylsulfonyl group, an amido group, a carboxyl group, a sulfo group, a nitro group, and an amino group. Exemplified compounds are:

I-1

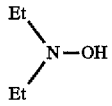

I-2

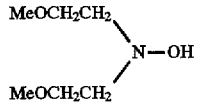

I-3

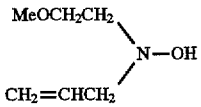

I-4

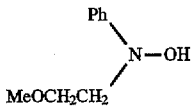

I-5

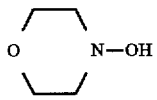

I-6

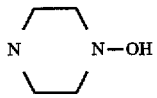

I-7

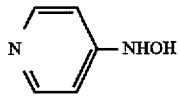

I-8

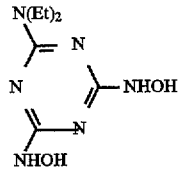

The hydrazines and hydrazides preferably include those represented by the formula II:

Formula (II)

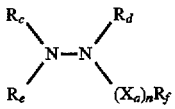

where $R_c$, $R_d$, and $R_e$, which may be the same or different, represents a hydrogen atom, a substituted or unsubstituted alkyl group, a substituted or unsubstituted aryl group, a substituted or unsubstituted heterocyclic group; $R_f$ represents a hydroxyl group, a hydroxylamino group, a substituted or unsubstituted alkyl group, a substituted or unsubstituted aryl group, a substituted or unsubstituted amino group, a substituted or unsubstituted alkoxyl group, a substituted or unsubstituted aryloxy group, a substituted to unsubstituted carbamoyl group, or a substituted or unsubstituted saturated or unsaturated 5- or 6-member heterocyclic group comprising carbon, oxygen, nitrogen, sulfur atoms, etc.; $X_a$ represents a divalent group selected from —CO—, —$SO_2$— and >C=NH and n represents 0 or 1; provided that when n is 0, $R_f$ is selected from an alkyl group, an aryl group, and a heterocyclic group; $R_d$ and $R_e$ may combine to form a heterocylic group.

In formula (II) $R_c$, $R_d$, $R_f$ each preferably represents a hydrogen atom or an alkyl group having from 1 to 10 carbon atoms. $R_c$ and $R_d$ each more preferably represent a hydrogen atom.

$R_f$ preferably represents an alkyl group, an aryl group, an alkoxyl group, a carbamoyl group, or an amino group, and more preferably an alkyl group or a substituted alkyl group. Preferred substituents on the alkyl group include a carboxyl group, a sulfo group, a nitro group, an amino group, a phosphono group, etc. $X_a$ preferably represents —CO— or —$SO_2$—, and most preferably represents —CO—.

Specific examples of the hydrazines and hydrazides represented by formula (II) are shown below.

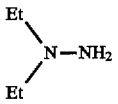
II-1

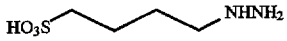
II-2

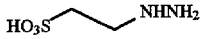
II-3

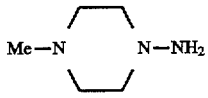
II-4

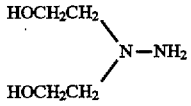
II-5

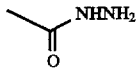
II-6

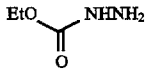
II-7

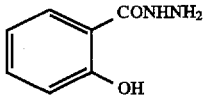
II-8

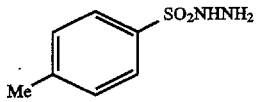
II-9

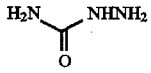
II-10

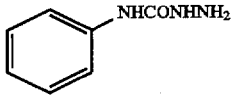
II-11

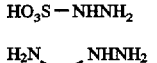
II-12

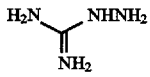
II-13

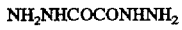
II-14

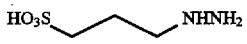
II-15

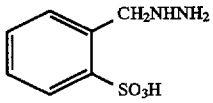
II-16

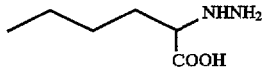
II-17

-continued

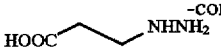
II-18

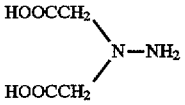
II-19

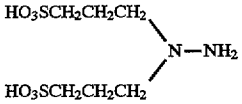
II-20

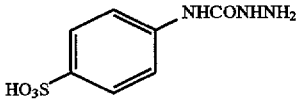
II-21

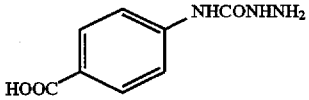
II-22

Other organic preservatives of potential use are mentioned by Yoshida, et. al., in U.S. Pat. No. 5,077,180 with lists of examples from each of the classes for the following organic preservative classes: hydroxamic acids, phenols, aminoketones, sacharides, monoamines, diamines, polyamines, quaternary ammonium salts, nitroxy radicals, alcohols, oximes, diamide compounds, and condensed ring-type amines. Additionally, a sulfinic acid or salt thereof may be used to improve the stability of the color developing agent in concentrated solutions, with examples described by Nakamura, et. al., in U.S. Pat. No. 5,204,229.

A further ingredient which can optionally be included in the color developing composition to improve the stability of the color developer and assure stable continuous processing represented by formula (III):

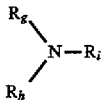
Formula (III)

where $R_g$, $R_h$, and $R_i$ each represents a hydrogen atom, a substituted or unsubstituted alkyl group, a substituted or unsubstituted alkenyl group, a substituted or unsubstituted aryl group, a substituted or unsubstituted aralkyl group, or a substituted or unsubstituted heterocyclic group; or $R_g$ and $R_h$, $R_g$ and $R_i$, or $R_h$ and $R_i$ may combine to form a nitrogen-containing heterocyclic ring. As described in Case et. al. U.S. Pat. No. 4,170,478 a preferred example of formula (III) are alkanolamines, wherein $R_g$ is an hydroxyalkyl group and each of $R_h$ and $R_i$ is a hydrogen atom, an alkyl group, a hydroxyalkyl group, an aryl group, or a —$C_nH_{2n}N(Y)Z$ group wherein n is an integer of from 1 to 6 and each of Y and Z is a hydrogen atom, an alkyl group or an hydroxylalkyl group.

Specific examples of the amine and hydroxylamine compounds represented by formula (III) are shown below.

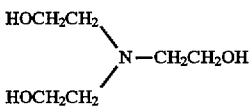
III-1

$H_2NCH_2CH_2OH$ III-2

$HOCH_2CH_2-NH-CH_2CH_2OH$ III-3

-continued

III-4

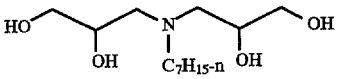

III-5

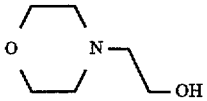

III-6

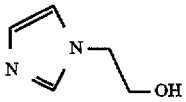

III-7

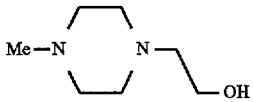

III-8

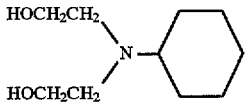

III-9

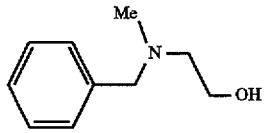

III-10

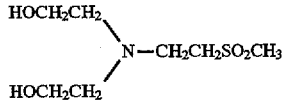

III-11

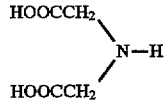

III-12

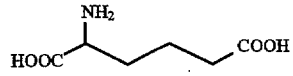

III-13

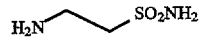

III-14

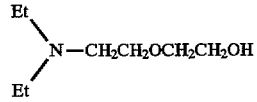

III-15

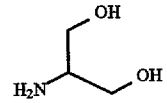

III-16

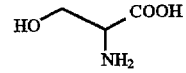

III-17

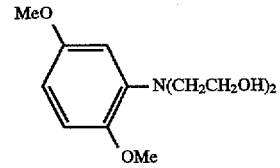

III-18

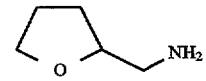

-continued

III-19

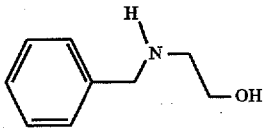

III-20

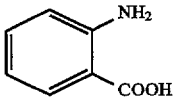

A small amount of sulfite can optionally be incorporated in the developing compositions to provide additional protection against oxidation. In view of the fact that sulfite competes in the developer with coupler for oxidized developing agent and can have a resultant effect to decrease the desired image dye formation, it is preferred that the amount of sulfite be very small, for example in the range from zero to 0.04 moles per liter. The use of a small amount of sulfite is especially desirable when the color developing composition is packaged in a concentrated form to preserve the concentrated solution from oxidation.

It is preferable that the developer is substantially free of hydroxylamine, often used as a developer preservative. This is because hydroxylamine has an undesired effect on the silver development and results in low yields of image dye formation. The expression 'substantially-free from hydroxylamine' means that the developer contains only 0.005 moles per liter or below of hydroxylamine per liter of developer solution.

To improve the clarity of the working developer solution and reduce the tendency for tarring to take place it is preferred to incorporate therein a water-soluble sulfonated polystyrene. The sulfonated polystyrene can be used in the free acid form or in the salt form. The free acid form of the sulfonated polystyrene is comprised of units having the formula:

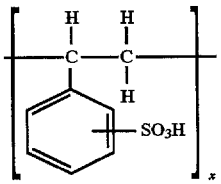

where X is an integer representing the number of repeating units in the polymer chain and is typically in the range from about 10 to about 3,000 and more preferably in the range from about 100 to 1,000.

The salt form of the sulfonated polystyrene is comprised of units having the formula:

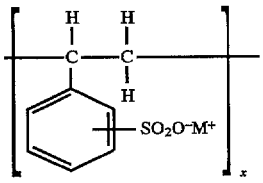

where X is as defined above and M is a monovalent cation, such as, for example, an alkali metal ion.

The sulfonated polystyrenes utilized in the developing compositions can be substituted with substituents such as halogen atoms, hydroxy groups, and substituted or unsubstituted alkyl groups. For example, they can be sulfonated derivatives of chlorostyrene, alpha-methyl styrene, vinyl toluene, and the like. Neither the molecular weight nor the degree of sulfonation are critical, except that the molecular weight should not be so high nor the degree of sulfonation so low as to render the sulfonated polystyrene insoluble in aqueous alkaline photographic color developing solutions. Typically, the average degree of sulfonation, that is the number of sulfonic acid groups per repeating styrene unit, is in the range from about 0.5 to 4 and more preferably in the range from about 1 to 2.5. A variety of salts of the sulfonated polystyrene can be employed, including, in addition to alkali metal salts, the amine salts such as salts of monoethanolamine, diethanoiamine, triethanolamine, morpholine, pyridine, picoline, quinoline, and the like.

The sulfonated polystyrene can be used in the working developer solution in any effective amount. Typically, it is employed in amount of from about 0.05 to about 30 grams per liter of developer solution, more usually in amount of from about 0.1 to about 15 grams per liter, and preferably in amounts of from 0.2 to about 5 grams per liter.

In addition various chelating agents may also be added to the developer to prevent calcium or magnesium from precipitating or to improve the stability of the color developer. Specific examples are shown below, but use with the present invention is not limited to them:

nitrilotriacetic acid, diethylenetriaminepentaacetic acid, ethylenediaminetetraacetic acid, triethylenetetraaminehexaaacetic acid, N,N,N-trimethylenephosphonic acid, ethylenediamine-N,N,N',N'-tetramethylenephosphonic acid, 1,3-diamino-2-propanoltetraacetic acid, trans-cyclohexanediaminetetraacetic acid, nitrilotripropionic acid, 1,2-diaminopropanetetraacetic acid, hydroxyethyliminodiacetic acid, glycol ether diaminetetraacetic acid, hydroxyethylenediaminetriacetic acid, ethylenediamine-o-hydroxyphenylacetic acid, 2-phosphonobutane-1,2,4-tricarboxylic acid, 1-hydroxyethylidene-1,1-diphosphonic acid, N,N'-bis(2-hydroxybenzyl)ethylenediamine-N,N'-diacetate, N-N'-bis(2-hydroxybenzyl)ethylenediamine-N,N'-diacetic acid, catechol-3,4,6-trisulfonic acid, catechol-3,5-disulfonic acid, 5-sulfosalycylic acid, 4-sulfosalicylic acid, beta-alaninediacetic acid, and glycinedipropionic acid.

A particularly useful chelating agent for photographic color developer compositions are the hydroxyalkylidene diphosphonic acid of the formula:

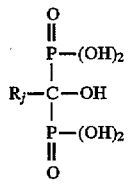

Formula (IV)

where $R_j$ is an alkyl or substituted alkyl group. When $R_j$ is an ethyl group a preferred chelating agent example, is 1-hydroxyethylidene-1,1-diphosphonic acid. The hydroxyalkylidene diphosphonic acid chelating agents can serve as both the chelating agent which functions to sequester calcium and which functions to sequester calcium, as they have the ability to effectively sequester both iron and calcium. As described in Brown, U.S. Pat. No. 3,839,045, they are preferably utilized in combination with small amounts of lithium salts, such as lithium sulfate or lithium chloride.

The chelating agents can be utilized in the form of a free acid or in the form of a water soluble salt form. If desired, the above mentioned chelating agents may be used as a combination of two or more. One preferred combination is demonstrated by Buongiorne, et. al., U.S. Pat. No. 4,975,357 as a combination of the class of polyhydroxy compounds, such as catechol-3,5-disulfonic acid, and of the class of an aminocarboxylic acid, such as ethylenetriamine pentaacetic acid.

It is preferable that the color developer be substantially free of benzyl alcohol. Herein the term 'substantially free of benzyl alcohol' means that the amount of benzyl alcohol is no more than 2 milliliters per liter, but even more preferably benzyl alcohol should not be contained at all.

It is preferred that the color developer contain a triazinyl stilbene type stain reducing agent, which is often referred to as a fluorescent whitening agent. There are a wide variety of effective stain reducing agents, preferred examples include Blankophor REU, and Tinopal SFP. The triazinyl stilbene type of stain reducing agent may be used in an amount within the range of, preferably 0.2 grams to 10 grams per liter of developer solution and more preferably, 0.4 to 5 grams per liter.

In addition, compounds can be added to the color developing solution to increase the solubility of the developing agent. Examples of materials, if required, include methyl cellosolve, methanol, acetone, dimethyl formamide, cyclodextrin, dimethyl formamide, diethylene glycol, and ethylene glycol.

It is also mentioned that the color developer solution may contain an auxiliary developing agent together with the color developing agent. Examples of known auxiliary developing agents include for example, N-methyl-p-aminophenol sulfate, phenidone, N,N-diethyl-p-aminophenol hydrochloride and an N,N,N'N'-tetramethyl-p-phenylenediamine hydrochloride. The auxiliary developing agent may be added in an amount within the range of, typically, 0.01 to 1.0 grams per liter of color developer solution.

It may be preferable, if required to enhance the effects of the color developer, to include an anionic, cationic, amphoteric and nonionic surfactant. If necessary, various other components may be added to the color developer solution, including dye-forming couplers, competitive couplers, and fogging agents such as sodium borohydride.

If desired, the color developing agent may contain an appropriate development accelerator. Examples of development accelerators include thioether compound as described in U.S. Pat. No. 3,813,247; quaternary ammonium salts; the amine compounds as described in U.S. Pat. Nos. 2,494,903, 3,128,182, 3,253,919, and 4,230,796; the polyalkylene oxides as described in U.S. Pat. No. 3,532,501.

An antifoggant may be added if required. Antifoggants that can be added include alkali metal halides, such as sodium or potassium chloride, sodium or potassium bromide, sodium or potassium iodide and organic antifoggants. Representative examples of organic antifoggants include nitrogen-containing heterocyclic compounds such as benzotriazole, 6-nitrobenzimidazole, 5-nitrobenzotriazole, 5-chloro-benzotriazole, 2-thiazolylbenzimidazole, 2-thiazolyl-methylbenzimidazole, indazoles, hydroxyazindolizine, and adenine.

The above mentioned color developer solutions may be used at a processing temperature of preferably 25° C. to 45° C. and more preferably from 35° C. to 45° C. Further, the color developer solution may be used with a processing time in the developer step of the process with a time of not longer than 240 seconds and preferably within a range from 3 seconds to 110 seconds, and more preferably not shorter than 5 seconds and not longer than 45 seconds.

As previously described, a color developer processing tank in a continuous processor is replenished with a replenisher solution to maintain the correct concentration of color developer solution components. The color developer replenisher solution may be replenished in an amount of, ordinarily not more than 500 milliliters per square meter of a light sensitive material. Since replenishment results in a quantity of waste solution, the rate of replenishment is preferably minimized so that waste volume and costs can be minimized. A preferred replenishment rate is within a range of 10 to 215 milliliters per square meter, and more preferably 25 to 160 milliliters per square meter.

Additionally the developer waste volume and material costs may be reduced by recovering the overflow from the developer tank as it is being replenished and treating the overflow solution in a manner so that the overflow solution can be used again as a replenisher solution. In one operating mode, chemicals are added to the overflow solution to make up for the loss of chemicals from that tank solution that resulted from the consumption of chemicals that occurred during the development reactions. The chemicals can be added as solid components or as aqueous solutions of the component chemicals. Addition of water and the aqueous solutions of the make-up chemicals also have the effect to reduce the concentration of the materials that wash out of the light-sensitive material and are present in the developer overflow. This dilution of materials that wash out of the light-sensitive material prevents concentration of these materials from increasing to concentrations that can lead to undesired photographic effects, reduced solution stability, and precipitates. The method for the regeneration of a developer is described in Kodak Publication No. Z-130, 'Using EKTACOLOR RA Chemicals'. If the materials that wash out of the light-sensitive material are found to increase to an objectionable concentration, the overflow solution can be treated to remove the objectionable material. Ion-exchange resins, cationic, anionic and amphoteric are especially well suited to remove specific components found to be objectionable. The recovery of developer solution overflow can be characterized as the percentage of the original replenisher solution that is recovered and reused, thus a 55% 'reuse ratio' indicates that of the original replenisher volume used, 55% of the original volume was recovered and reused. A packaged chemical mix of concentrated chemical solution-sconcentrates can be designed to be used with a designated amount of overflow to produce a replenisher solution for use in the continuous processor being used to process the light sensitive material. While it is useful to be able to recover any amount of developer overflow solution, it is preferable to be able to recover at least 50% (ie. a 50% reuse ratio) of the developer overflow. It is preferred to have a reuse ratio of 50% to 75% and it is more preferred to have a reuse ratio of 50% to 95%.

It is an objective for use with the current invention to produce a color photographic light sensitive material where substantially all of the silver that was originally used in producing the photographic images is removed from the light-sensitive material during the processing stage. In a preferred example, both the developed and undeveloped silver is removed in a single processing step using a bleach-fix solution.

The components of a bleach-fix solution are comprised of silver halide solvents, preservatives, bleaching agents, chelating agents, acids, and bases. Each of the components may be used as single components or as mixtures of two or more components.

As silver solvents, thiosulfates, thiocyanates, thioether compounds, thioureas, and thioglycolic acid can be used. A preferred component is thiosulfate, and ammonium thiosulfate, in particular is used most commonly owing to the high solubility. If desired, other counter ions may be used in place of ammonium ion. Alternative counter-ions such as potassium, sodium, lithium, cesium as well as mixtures of two or more cations are mentioned and would have advantages to be able to eliminate ammonia from the waste volume.

The concentration of these silver halide solvents is preferably between 0.1 and 3.0 moles per liter and more preferably between 0.2 and 1.5 mole per liter.

As preservatives sulfites, bisulfites, metabisulfites, ascorbic acid, carbonyl-bisulfite adducts or sulfinic acid compounds are typically used. The use of sulfites, bisulfites, and metabisulfites are especially desirable. The concentration of preservatives is preferably present from zero to 0.5 moles per liter and more preferably between 0.02 and 0.4 moles per liter.

The use of a ferric complex salt of an organic acid is preferred for the bleaching agent and the use of ferric complex salts of aminopolycarboxylic acids is especially desirable. Examples of these aminopolycarboxylic acids are indicated below, but are not limited only to those listed.

| | |
|---|---|
| Ethylenediaminetetraacetic acid | V-1 |
| Diethylenetriaminepentaacetic acid | V-2 |
| Cyclohexanediaminetetraacetic acid | V-3 |
| 1,2-Propylenediaminetetraacetic acid | V-4 |
| Ethylenediamine-N-(beta-oxyethylene)-N,N',N'-triacetic acid | V-5 |
| 1,3-Diaminopropanetetraacetic acid | V-6 |
| 1,4-diaminobutanetetraacetic acid | V-7 |
| Glycol ether diaminetetraacetic acid | V-8 |
| Iminodiacetic acid | V-9 |
| N-Methyliminodiacetic acid | V-10 |
| Ethylenediaminetetrapropionic acid | V-11 |
| (2-Acetamindo)iminodiacetic acid | V-12 |
| Dihydroxyethylglycine | V-13 |
| Ethylenediaminedi-o-hydroxyphenylacetic acid | V-14 |
| Nitrilodiacetomonopropionic acid | V-15 |
| Glycinedipropropionic acid | V-16 |
| Ethylenediaminedisuccinic acid | V-17 |
| N,N-Dicarboxyanthranilic acid | V-18 |
| Nitrilotriacetic acid | V-19 |
| b-alaninediacetic acid | V-20 |

Compounds V-1, V-2, V-3 and V-6 are preferred among the listed campounds. If desired, a combination of two or more of the aminopolycarboxylic acid may be used. Preferably the ferric complex salt may be used with a concentration between 0.01 to 1.0M and more preferably between 0.05 and 0.5M. Also useful are ternary ferric-complex salts formed by a tetradentate ligand and a tridentate ligand. In a preferred embodiment the tridentate ligand is represented by formula VI and the tetradentate ligand is represented by formula VII:

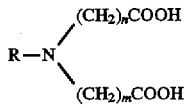

VI

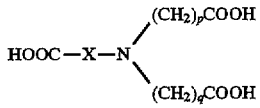

VII wherein R is H or an alkyl group; m,n,p and q are 1, 2, or 3; and X is a linking group. These are further described in U.S. application Ser. No. 08/128,626, filed Sep. 28, 1993.

If desired, additional chelating agents may be present in the bleach-fix solution to maintain the solubility of the ferric complex salt.

Aminopolycarboxylic acids are generally used as chelating agents. The chelating agent may be the same as the organic acid in use with the ferric complex salt, or it may be a different organic acid. Examples of these complexing agents are compounds V-1 to V-20, as shown above, but are not to be construed as limited only to those listed. Among these, V-1, V-2, V-3, and V-6 are preferred. These may be added in the free form or in the form of alkali metal salts or ammonium salts. The amount added to the bleach-fix solution is preferably 0.01 to 0.1M and more preferably between 0.005 and 0.05M.

The pH value of the bleach-fix solution is preferably in the range of about 3.0 to 8.0 and most preferably in the range of about 4.0 to 6.5. In order to adjust the pH value to the above mentioned range and to maintain good pH control, a weak organic acid with a pKa between 4 and 6, such as acetic acid, glycolic acid or malonic acid can be added in conjunction with an alkaline agent such as aqueous ammonia. The buffering acid helps maintain consistence performance of the bleaching reaction.

In addition, mineral acids such as hydrochloric acid, nitric acid, sulfuric acid and phosphoric acid can normally be used for the acid component and these acids can be used as a mixture with one or more salt of the weak acids previously mentioned above in order to provide a buffering effect.

Furthermore, halides (halogenating agents) may be added to the bleach-fix, if desired, halides include bromides, such as potassium bromide, sodium bromide, or arnmonium bromide; or chlorides, such as potassium chloride, sodium chloride, or ammonium chloride.

Bleaching accelerators, brightening agents, defoaming agents, surfactants, fungicides, anti-corrosion agents and organic solvents, such as polyvinylpyrrolidone or methanol, as examples, may be added, if desired.

The bleach-fix replenisher solution can be directly replenished to the bleach-fix solution to maintain chemical concentrations and pH conditions adequate to completely remove the silver from the photographic light-sensitive material. The volume of replenishment solution added per square meter of photographic light-sensitive material can be considered to be a function of the amount of silver present in the photographic light-sensitive material. It is preferred to use low volumes of replenishment solution so low silver materials are preferred. Also, bleach-fix overflow can be reconstituted as described in U.S. Pat. No. 5,063,142 and European Patent Application No. 410,354 or in Long et. al., U.S. Pat. No. 5,055,382.

The bleach-fix time may be about 10 to 240 seconds, with 40 to 60 seconds being a preferred range, and between 25 and 45 seconds being most preferred. The temperature of the bleach-fix solution may be in the range from 20° to 50° C. with a preferred range between 25° and 40° C. and a most preferred range between 35° and 40° C.

To minimize the volume of bleach-fix solution that is needed to process the light-sensitive photographic material, the bleach-fix solution can be recovered and treated to remove the silver from the solution by means of electrolysis, precipitation and filtration, metallic replacement with another metal, or ion-exchange treatment with a material that will remove the silver. The desilvered solution can then be reconstituted to return the chemical concentrations to the replenisher concentration to make up for the chemicals consumed during the bleach-fixing of the light-sensitive photographic material or during the silver recovery treatment process, or to compensate for the dilution of the constituents caused by the carryover of solution from the previous processing stage in the process. The degree of recovery of bleach-fix solution can be measured by comparing the volume of solution that can be recovered and reused as a percentage of the original volume that was used in the process. Thus a 90% reuse recovery ratio would occur when from an original 100 L of replenisher volume 90 L would be treated and recovered to produce 100 L of regenerated fixer replenisher. The recovery reuse ratio of greater than 50% is preferred, greater than 75% is more preferred and greater than 90% is most preferred.

When an alternative process sequence is desired, separate solutions may be used for the bleaching and fixing steps. For the bleaching step, the use of a ferric complex salt of cyanide, halides, or an organic acid may be employed as the bleaching agent. The use of ferric complex salts of aminopolycarboxylic acids have been especially desirable. Examples of these complexing agents are compounds V-1 to V-20, as shown above, but are not limited only to those listed. Among these, Nos. V-1, V-2, V-3, and V-6 are preferred. If desired a combination of two or more of the aminopolycarboxylic acids may be used. Preferably the ferric complex salt may be used with a concentration between 0.01 to 1.0M and more preferably between 0.05 and 0.5M.

If desired, additional chelating agents may be present in the bleach solution to maintain the solubility of the ferric complex salt. Aminopoly-carboxylic acids are generally used as chelating agents. The chelating agent may be the same as the organic acid in use with the ferric complex salt, or it may be a different organic acid. Examples of these complexing agents are V-1 to V-20; however, use with elements of the present photographic element is not to be construed as being limited only to those listed. Among these, V-1, V-2, V-3, and V-6 are preferred. These may be added in the free acid form or in the form of alkali metal salts, such as sodium, or potassium, or ammonium or tetraalkylammonium salts. It may be preferable to use alkali metal cations to avoid the aquatic toxicity associated with ammonium ion. The amount of the ferric complex salt added to the bleach solution is preferably 0.01 to 0.1M and more preferably between 0.005 and 0.05M.

Furthermore, halides (halogenating agents) are included in the bleach so that silver halide salts can form during the bleaching reactions. Halides include bromides, such as potassium bromide, sodium bromide, or ammonium bromide; or chlorides, such as potassium chloride, sodium chloride, or ammonium chloride.

The pH value of the bleach solution is preferably in the range of about 3.0 to 8.0 and most preferably in the range of about 4.0 to 6.5. In order to adjust the pH value to the above mentioned range and to maintain good pH control, a weak organic acid with a pKa between 1.5 and 7, preferably between 3 and 6, such as acetic acid, glycolic acid or malonic acid can be added in conjunction with an alkaline agent such as aqueous ammonia. The buffering acid helps maintain consistent performance of the bleaching reaction.

In addition, mineral acids such as hydrochloric acid, nitric acid, sulfuric acid and phosphoric acid can normally be used for the acid component and these acids can be used as a mixture with one or more salt of the weak acids previously mentioned above in order to provide a buffering effect.

Bleaching accelerators, brightening agents, defoaming agents, surfactants, fungicides, anti-corrosion agents and organic solvents, such as polyvinylpyrrolidone or methanol, as examples, may be added, if desired.

The bleach replenisher solution can be directly replenished to the bleach solution to maintain chemical concentrations and pH conditions adequate to convert the metallic silver to the ionic state as a silver halide salt. The volume of replenishment solution added per square meter of photographic light-sensitive material can be considered to be a function of the amount of silver present in the photographic light-sensitive material. It is preferred to use low volumes of replenishment solution so low silver materials are preferred. It is also preferred to use ferric complex salts organic acids with organic acid chelating agents that are biodegradable to reduce any undesirable environmental impact.

Other bleaching agents which may be used with this photographic element include compounds of polyvalent metal such as cobalt (III), chromium (VI) and copper (II), peracids, quirtones, and nitro compounds. Typical peracid bleaches include the hydrogen, alkali and alkali earth salts of persulfate, peroxide, perborate, perphosphate, and percarbonate, oxygen, and the related perhalogen bleaches such as hydrogen, alkali and alkali earth salts of chlorate, bromate, iodate, perchlorate, perbromate and metaperiodate. Examples of formulations using these agents are described in *Research Disclosure*, September 1994, item 36544, the disclosures of which are incorporated herein by reference. Useful persulfate bleaches are particularly described in *Research Disclosure*, May, 1977, Item 15704; *Research Disclosure*, August, 1981, Item 20831; DE 3,919,551 and U.S. Pat. application Ser. No. 07/990,500 filed December 14, 1992. Additional hydrogen peroxide formulations are described in U.S. Pat. Nos. 4,277,556; 4,328,306; 4,454,224; 4,717,649; 4,294,914; 4,737,450; and in EP 90 121624; WO 92/01972 and WO 92/07300.

Especially preferred peracid bleaches are persulfate bleaches. With sodium, potassium, or ammonium persulfate being particularly preferred. For reasons of economy and stability, sodium persulfate is most commonly used.

The bleach time may be about 10 to 240 seconds, with 40 to 90 seconds being a preferred range, and between 25 and 45 seconds being most preferred. The temperature of the bleach solution may be in the range from 20° to 50° C. with a preferred range between 25° and 40° C. and a most preferred range between 35° and 40° C.

To minimize the volume of bleach solution that is needed to process the light-sensitive photographic material, the bleach solution can be recovered and treated to return the chemical concentrations to the replenisher concentration to make up for any chemicals consumed during the bleaching of the light-sensitive photographic material or to compensate for the dilution of the bleach constituents by the carryover of solution from the previous processing stage in the process. The treatment to return the chemical conentrations to the replenisher concentration can be accomplished by the addition of chemicals as solid materials or as concentrated solutions of the chemicals. The degree of recovery of bleach solution can be measured by comparing the volume of solution that can be recovered and reused as a percentage of the original volume that was used in the process. Thus a 90% reuse recovery ratio, would occur when from an original 100 L of replenisher volume 90 L would be treated and recovered to produce 100 L of regenerated bleach replenisher. The recovery reuse ratio of greater than 50% is preferred, greater than 75% is more preferred and greater than 90% is most preferred.

Preferably, a stop bath or a stop-accelerator bath of pH less than or equal to 7.0 precedes the bleaching step and a wash bath may follow the bleach step to reduce the carryover of the bleach solution into the following fixer solution.

When a separate bleach and fixer is used, the fixer includes silver solvents, thiosulfates, thiocyanates, thioether compounds, thioureas, and thioglycolic acid can be used. A preferred component is thiosulfate, and ammonium thiosulfate, in particular is used most commonly owing to the high solubility. If desired, other counter ions may be used in place of ammonium ion. Alternative counter-ions such as potassium, sodium, lithium, cesium as well as mixtures of two or more cations are mentioned and would have advantages to be able to eliminate ammonia from the waste volume.

The concentration of these silver halide solvents is preferably between 0.1 and 3.0M and more preferably between 0.2 and 1.5M.

As preservatives sulfites, bisulfites, metabisulfites, ascorbic acid, carbonyl-bisulfite adducts or sulfinic acid compounds are typically used. The use of sulfites, bisulfites, and metabisulfites are especially desirable. The concentration of preservatives is preferably present from zero to 0.5M and more preferably between 0.02 and 0.4M.

The fixer time may be about 10 to 240 seconds, with 40 to 90 seconds being a preferred range, and between 25 and 45 seconds being most preferred. The temperature of the fixer solution may be in the range from 20° to 50° C. with a preferred range between 25° and 40° C. and a most preferred range between 35° and 40° C.

To minimize the volume of fixer solution that is needed to process the light-sensitive photographic material, the fixer solution can be recovered and treated to remove the silver from the solution by means of electrolysis, precipitation and filtration, metallic replacement with another metal, or ion-exchange treatment with a material that will remove the silver. The desilvered solution can then be reconstituted to return the chemical concentrations to the replenisher concentration to make up for the chemicals consumed during the fixing of the light-sensitive photographic material or during the silver recovery treatment process, or to compensate for the dilution of the constituents by the carryover of solution from the previous processing stage in the process. The treatment to return the chemical conentrations to the replenisher concentration can be accomplished by the addition of chemicals as solid materials or as concentrated solutions of the chemicals. The degree of recovery of fixer solution can be measured by comparing the volume of solution that can be recovered and reused as a percentage of the original volume that was used in the process. Thus a 90% reuse recovery ratio would occur when from an original 100 L of replenisher volume 90 L would be treated and recovered to produce 100 L of regenerated fixer replenisher. The recovery reuse ratio of greater than 50% is preferred, greater than 75% is more preferred and greater than 90% is most preferred.

Preferably, following the fixer bath is a wash bath to remove chemicals from the processing solution before it is dried. Preferably the wash stage is accomplished with multiple stages to improve the efficiency of the washing action. The replenishment rate for the wash water is between 20 and 10,000 mL per square meter, preferably between 150 and 2000 mL per square meter. The solution can be recirculated with a pump and filtered with a filter material to improve the efficiency of washing and to remove any particulate matter that results in the wash tank. The temperature of the wash water is 20° to 50° C., preferably 30° to 40° C. To minimize the volume of water being used, the wash water that has been used to process the light-sensitive photographic material can be recovered and treated to remove chemical constituents that have washed out of the light-sensitive photographic material or that has been carried over from a previous solution by the light sensitive material. Common treatment procedures would include use of ion-exchange resins, precipitation and filtration of components, and distillation to recover purer water for reuse in the process.

To minimize the amount of water that is used to wash the light sensitive material, a solution may be employed that uses a low-replenishment rate over the range of 20 to 2000 mL per square meter, preferably between 50 and 400 mL per square meter and more preferably between 100 and 250 mL per square meter. When the replenishment rate is reduced, problems with precipitates and biogrowth may be encountered. To minimize these problems, agents can be added to control the growth of bio-organisms, for example 5-chloro-2-methyl-4-isothiazolin-3-one, 2-methyl-4-isothiazolin-3-one and 2-octyl-4-isothiazolin-3-one. To prevent precipitation formation preferable agents which may be added include polymers or copolymers having a pyrrolidone nucleus unit, with poly-N-vinyl-2-pyrrolidone as a preferred example. Other agents which may be added include a chelating agent from the aminocarboxylate class of chelating agents such as those that were listed previously in the description of developer constituents; a hydroxyalkylidene-diphosphonic acid, with 1-hydroylethylidene-1,1-diphosphonic acid being a preferred material; an organic solubilizing agent, such as ethylene glycol; stain-reducing agents such as those mentioned as stain reducing agents for the developer constituents; acids or bases to adjust the pH; and buffers to maintain the pH.

The stabilizer solution may also contain formaldehyde as a component to improve the stability of the dye images. However, it is preferred to minimize or eliminate the formaldehyde for safety reasons. The formaldehyde concentration can be reduced by using materials that are precursors for formaldehyde, examples include N-methylol-pyrazole, hexamethylenetetramine, formaldehyde-bisulfite adduct, and dimethylol urea.

To improve the efficiency of the wash it is preferred to use multiple wash stages with countercurrent replenishment of the stabilizer solution. The wash time may be about 10 to 240 seconds, with 40 to 100 seconds being a preferred range, and between 60 and 90 seconds being most preferred. The temperature of the wash stage bleach-fix solution may be in the range from 20° to 50° C. with a preferred range between 25° and 40° C. and a most preferred range between 35° and 40° C. To further minimize the volume of water being used, the stabilizer solution that has been used to process the light-sensitive photographic material can be recovered and treated to remove chemical constituents that have washed out of the light-sensitive photographic material or that has been carried over from a previous solution by the light sensitive material. Common treatment procedures would include use of ion-exchange resins, precipitation and filtration of components, and distillation to recover purer water for reuse in the process.

The following examples illustrate the practice of this invention. They are not intended to be exhaustive of all possible variations of the invention. Parts and percentages are by weight unless otherwise indicated.

EXAMPLES

Photographic Papers.

Although the examples illustrate the practice of the invention at two resolutions, 500 ppi and 250 ppi, the scope of the invention applies to the full range of resolutions between 500 ppi and 200 ppi. Furthermore, it should also be recognized that the invention applies to other digital optical writing devices such as LEDs.

The following Comparative Examples 1–5 utilize commercially available color papers from Eastman Kodak Company and Fuji Film Company. These papers all use high chloride emulsions and red and green sensitive layers with negative working emulsions. They are representative of the color paper available in the market and illustrate that the performance of commercially available papers with a laser imaging device is significantly less than the performance of color papers formed in accordance with the invention.

Comparative Example 1. Edge paper (Eastman Kodak Co.)

Comparative Example 2. Edge II paper (Eastman Kodak Co.)

Comparative Example 3. Portra II paper (Eastman Kodak Co.)

Comparative Example 4. Fuji-FA3 paper (Fuji Film Co.)

Comparative Example 5. Fuji Type P paper (Fuji Film Co.)

Invention Example 1.

Silver chloride emulsions (>95% Cl) were chemically and spectrally sensitized as is described below.

Blue Sensitive Emulsion (Blue EM-1): A silver chloride emulsion was precipitated by adding approximately equimolar silver nitrate and sodium chloride solutions into a well-stirred reactor containing gelatin peptizer and thioether ripener. $Cs_2Os(NO)Cl_5$ dopant was added during the make. The resultant emulsion contained cubic shaped grains of 0.8 μm in edgelength size. This emulsion was optimally sensitized by the addition of a colloidal suspension of aurous sulfide and heat ramped up to 60° C. during which time blue sensitizing dye BSD-2 and Lippmann bromide/1-(3-acetamidophenyl)-5-mercapto-tetrazole were added. In addition, 1-(3-acetamidophenyl)-5-mercaptotetrazole and iridium dopant were added during the sensitization process.

Green Sensitive Emulsion (Green EM-1): A high chloride silver halide emulsion was precipitated by adding approximately equimolar silver nitrate and sodium chloride solutions into a well-stirred reactor containing oxidized gelatin peptizer and thioether ripener. $Cs_2Os(NO)Cl_5$ dopant and iridium were added during the silver halide grain formation. The resultant emulsion contained cubic shaped grains of 0.55 μm in edgelength size. This emulsion was optimaliy sensitized by addition of a colloidal suspension of aurous sulfide, heat digestion, followed by the addition of green sensitizing dye GSD-1. 1-(3-acetamidophenyl)-5-mercaptotetrazole and potassium bromide were added after the finish at 40° C.

Red Sensitive Emulsion (Red EM-1): A high chloride silver halide emulsion was precipitated by adding approximately equimolar silver nitrate and sodium chloride solutions into a well-stirred reactor containing gelatin peptizer and thioether ripener. $Cs_2Os(NO)Cl_5$ dopant was added during the silver halide grain formation. The resultant emulsion contained cubic shaped grains of 0.60 μm in edge length size. Alternatively a 0.4 μm grain may be used. This emulsion was optimally sensitized by the addition of a colloidal suspension of aurous sulfide followed by a heat ramp, and addition of Lippmann bromide/1-(3-acetamidophenyl)-5-mercaptotetrazole, additional 1-(3-acetamidophenyl)-5-mercaptotetrazole, potassium bromide, red sensitizing dye RSD-2, a small amount of RSD-1, and supersensitizer SS-1 (or alternatively with SS-2 instead of SS-1). Iridium dopant was added during the sensitization process.

Ruthenium dopant may be added in the make or finish, and aurous sulfide may be substituted with sulfur+gold.

Coupler dispersions were emulsified by methods well known to the art, and the following layers were coated on a polyethylene resin coated paper support, that was sized as described in U.S. Pat. No. 4,994,147 and pH adjusted as described in U.S. Pat. No. 4,917,994. The polyethylene layer coated on the emulsion side of the support contained a mixture of 0.1% (4,4'-bis(5-methyl-2-benzoxazolyl) stilbene and 4,4'-bis(2-benzoxazolyl) stilbene, 12.5% $TiO_2$, and 3% ZnO white pigment. The layers were hardened with bis (vinylsulfonyl methyl) ether at 2.4% of the total gelatin weight. AgX laydowns are with respect to the amount of Ag.

| | mg/ft$^2$ | g/m$^2$ |
|---|---|---|
| Layer 1: Blue Sensitive Layer | | |
| Gelatin | 140.0 | 1.54 |
| Blue Sensitive Silver (Blue EM-1) | 25.0 | 0.275 |
| Y-1 | 100.0 | 1.10 |
| ST-6 | 24.0 | 0.264 |
| Dibutyl phthalate | 33.0 | 0.363 |
| 2-(2-butoxyethoxy)ethyl acetate | 28.0 | 0.308 |
| 2,5-Dihydroxy-5-methyl-3-(1-piperidinyl)-2-cyclopenten-1-one | 0.2 | 0.002 |
| ST-16 | 0.8 | 0.009 |
| Layer 2: Interlayer | | |
| Gelatin | 70.0 | 0.770 |
| Dioctyl hydroquinone | 6.1 | 0.067 |
| Dibutyl phthalate | 17.5 | 0.193 |
| Disodium 4,5 Dihydroxy-m-benzenedisulfonate | 6.0 | 0.066 |
| SF-1 | 0.2 | 0.002 |
| Irganox 1076 ™ | 0.9 | 0.010 |
| Layer 3: Green Sensitive Layer | | |
| Gelatin | 115.0 | 1.270 |
| Green Sensitive Silver (Green EM-1) | 22.4 | 0.246 |
| M-1 | 39.3 | 0.432 |
| Tris (2-ethylhexyl)phosphate | 38.0 | 0.418 |
| 2-(2-butoxyethoxy)ethyl acetate | 6.4 | 0.070 |
| ST-2 | 30.4 | 0.334 |
| Dioctyl hydroquinone | 3.9 | 0.043 |
| 1-Phenyl-5-mercaptotetrazole | 0.1 | 0.001 |
| KCl | 1.9 | 0.021 |
| Layer 4: UV Interlayer | | |
| Gelatin | 56.5 | 0.622 |
| UV-1 | 3.4 | 0.037 |
| UV-2 | 19.0 | 0.209 |
| Dioctyl hydroquinone | 4.0 | 0.044 |
| 1,4-Cyclohexylenedimethylene bis(2-ethylhexanoate | 7.4 | 0.082 |
| Layer 5: Red Sensitive Layer | | |
| Gelatin | 133.0 | 1.463 |
| Red Sensitive Silver (Red EM-1) | 17.9 | 0.197 |
| C-3 | 39.4 | 0.433 |
| Dibutyl phthalate | 38.5 | 0.423 |
| UV-2 | 25.3 | 0.278 |
| 2-(2-butoxyethoxy)ethyl acetate | 3.2 | 0.035 |
| Dioctyl hydroquinone | 0.48 | 0.005 |
| Potassium tolylthiosulfonate | 0.05 | 0.0006 |
| Potassium tolylsulfinate | 0.005 | 0.00006 |
| Layer 6: UV Overcoat | | |
| Gelatin | 56.5 | 0.621 |
| UV-1 | 3.4 | 0.037 |

-continued

| | mg/ft$^2$ | g/m$^2$ |
|---|---|---|
| UV-2 | 19.0 | 0.209 |
| Dioctyl hydroquinone | 4.0 | 0.044 |
| 1,4-Cyclohexylenedimethylene bis(2-ethylhexanoate) | 7.4 | 0.082 |
| Layer 7: SOC | | |
| Gelatin | 125.0 | 1.375 |
| Dioctyl hydroquinone | 1.5 | 0.017 |
| Dibutyl phthalate | 4.5 | 0.050 |
| SF-1 | 0.8 | 0.009 |
| SF-2 | 0.4 | 0.004 |
| DYE-1 | 0.5 | 0.006 |
| DYE-2 | 1.9 | 0.021 |
| DYE-2 | 0.6 | 0.007 |

The blue layer of the multilayer may be modified in the following manner. Emulsion EM-2 is a high chloride <100> tabular grain emulsion which is produced as described by U.S. Pat. Nos. 5,314,798, 5,320,938 and 5,356,764. Yellow coupler Y-1 may alternately be substituted by Y-5.

| Alternate Blue Layer I<br>Layer 1: Blue Sensitive Layer | | |
|---|---|---|
| Gelatin | 140.0 | 1.54 |
| Blue Sensitive Silver (Blue EM-2) | 25.0 | 0.275 |
| Y-1 | 100.0 | 1.10 |
| ST-6 | 24.0 | 0.264 |
| Dibutyl phthalate | 33.0 | 0.363 |
| 2-(2-butoxyethoxy)ethyl acetate | 28.0 | 0.308 |
| 2,5-Dihydroxy-5-methyl-3-(1-piperidinyl)-2-cyclopenten-1-one | 0.2 | 0.002 |
| ST-16 | 0.8 | 0.009 |

The green layer of the multilayer may be modified in the following manner.

| Alternate Green Layer I<br>Layer 3: Green Sensitive Layer | | |
|---|---|---|
| Gelatin | 114.0 | 1.230 |
| Green Sensitive Silver | 12.0 | 0.129 |
| M-7 | 27.0 | 0.291 |
| Dibutyl phthalate | 27.0 | 0.291 |
| ST-7 | 10.5 | 0.131 |
| ST-19 | 10.5 | 0.131 |
| ST-22 | 18.1 | 0.195 |
| 1-(3-Benzamidophenyl)-5-mercaptotetrazole | 0.09 | 0.001 |
| DYE-2 | 0.94 | 0.010 |

The red layer of the multilayer may be modified in the following manner.

| Alternate Red Layer I<br>Layer 5: Red Sensitive Layer | | |
|---|---|---|
| Gelatin | 129.0 | 1.389 |
| Red Sensitive Silver | 17.4 | 0.187 |
| C-3 | 39.3 | 0.423 |
| Dibutyl phthalate | 38.6 | 0.415 |
| UV-2 | 25.3 | 0.272 |
| 2-(2-butoxyethoxy)ethyl acetate | 3.25 | 0.035 |
| Dioctyl hydroquinone | 0.46 | 0.005 |
| Potassium tolylthiosulfonate | 0.28 | 0.003 |
| Potassium tolylsulfinate | 0.028 | 0.0003 |
| Silver phenylmercaptotetrazole | 0.084 | 0.0009 |
| DYE-3 | 2.14 | 0.023 |

Structures of examples.
BSD-1
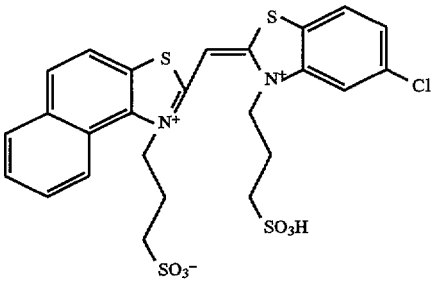
BSD-2
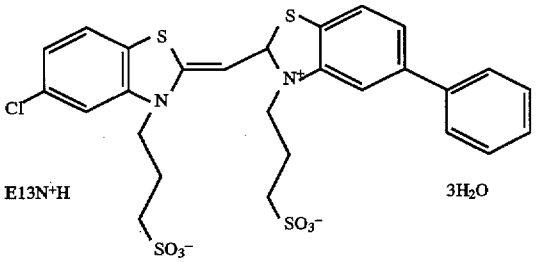
BSD-4
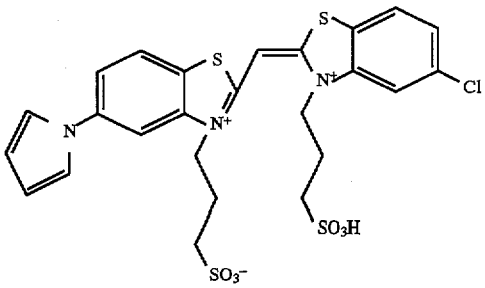
GSD-1
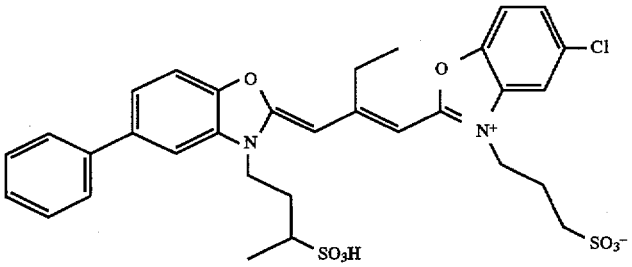
RSD-1
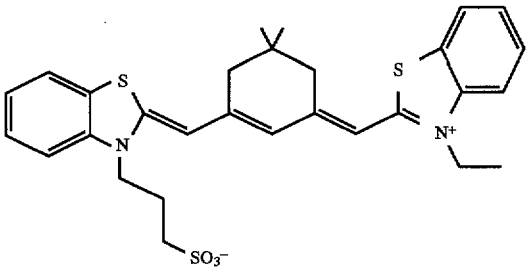
RSD-2
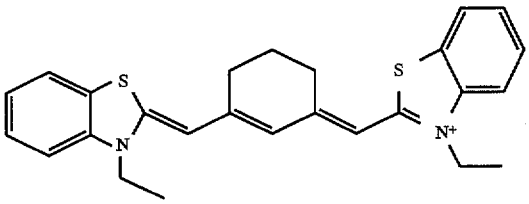

-continued
SS-1
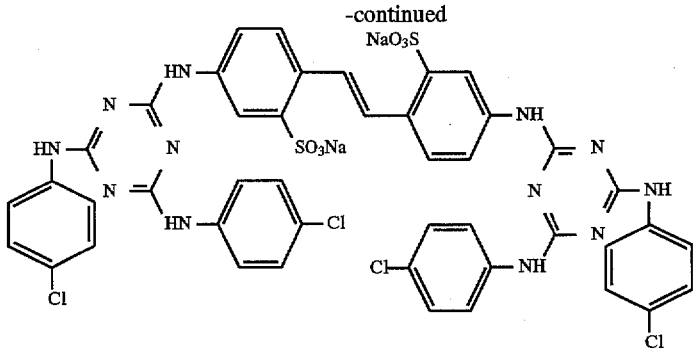
SS-2
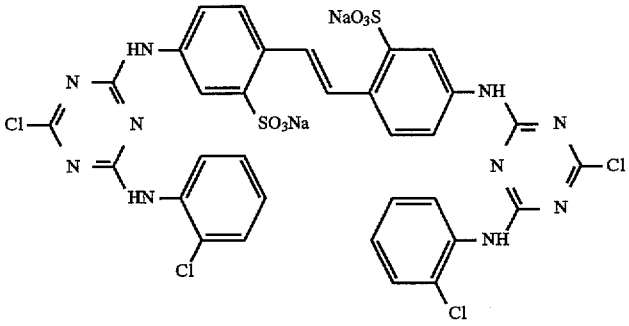
Y-1
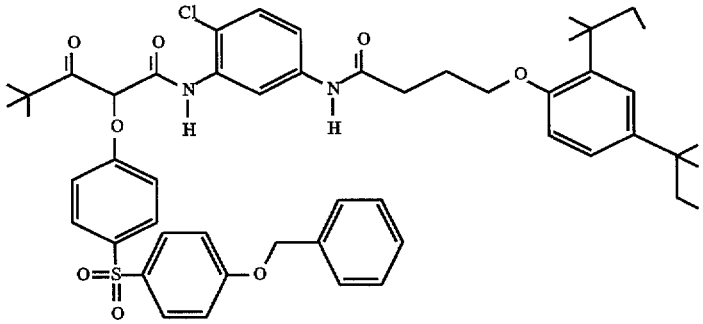
Y-5
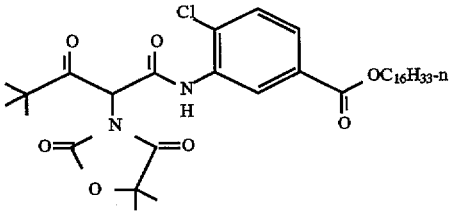
M-7
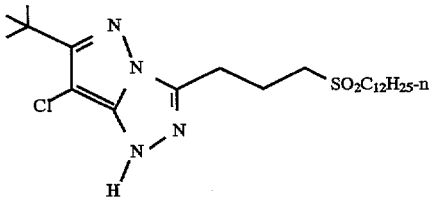
C-3
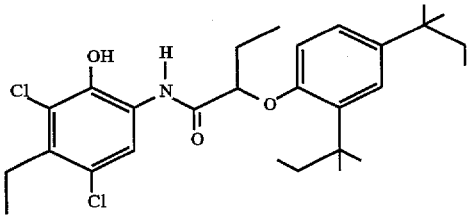

-continued
ST-6
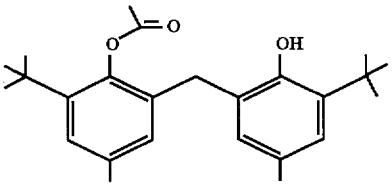
ST-7
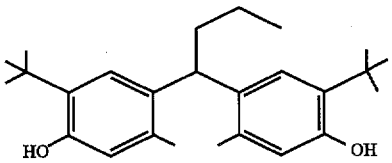
ST-8
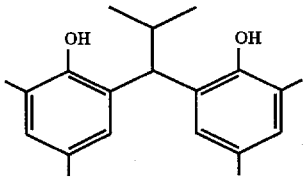
ST-16
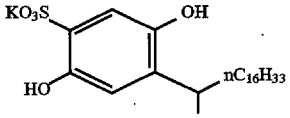
ST-21
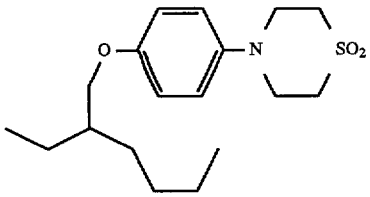
ST-22
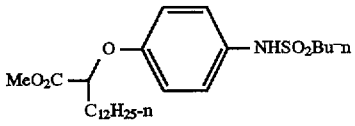
DYE-1
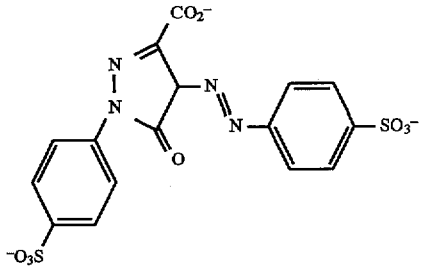
DYE-2
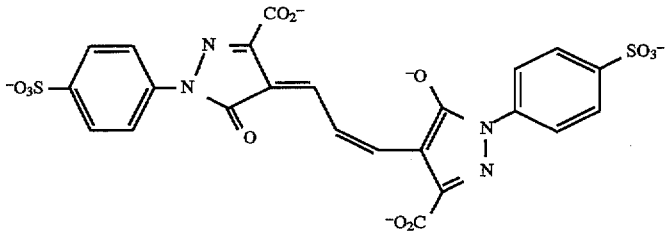

-continued

DYE-3

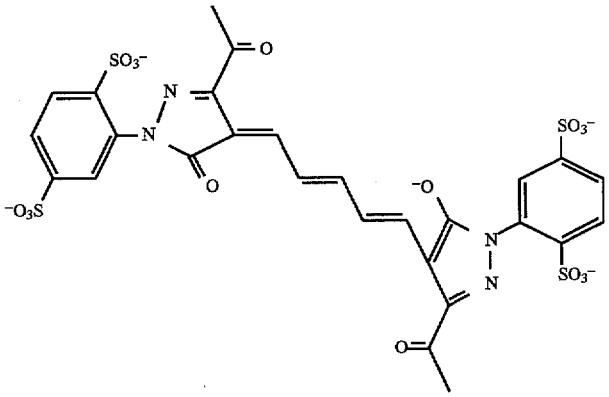

UV-1

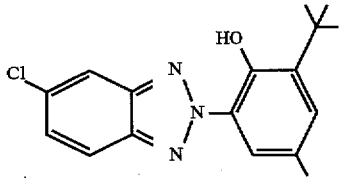

UV-2

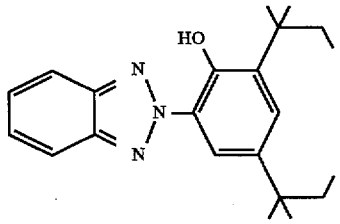

SF-1

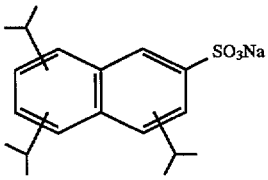

SF-2

$CF_3(CF_2)_7SO_3Na$

BIO-1

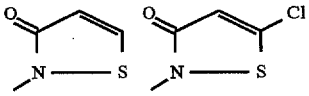

Invention Example 2.

This preparation was identical to Invention Example 1 except the silver laydowns were increased 15%.

Invention Example 3.

This preparation was identical to Invention Example 1 except the silver laydowns were increased 30%.

The photographic properties of the above described comparative and invention examples, after digital exposure according to Print Methods 1 and 2 and rapid access development, are shown in Tables 4 and 5.

TABLE 4

| | | | | 250 ppi | | |
|---|---|---|---|---|---|---|
| | Coating | Color Record | | Fill-In Dmax (Status A) | Fill-In Range (Log E) | Peak Gamma |
| Comp Ex. 1 | Edge | r | $D_c$ | 1.34 | 0.9 | 2.1 |
| | | g | $D_m$ | 1.29 | 0.9 | 1.7 |

TABLE 4-continued

| | | | | 250 ppi | | |
|---|---|---|---|---|---|---|
| | Coating | Color Record | | Fill-In Dmax (Status A) | Fill-In Range (Log E) | Peak Gamma |
| | | b | $D_y$ | 0.96 | 0.8 | 1.3 |
| Comp Ex. 2 | Edge II | r | $D_c$ | 1.12 | 0.8 | 2.3 |
| | | g | $D_m$ | 1.23 | 0.9 | 1.9 |
| | | b | $D_y$ | 1.03 | 0.9 | 1.4 |
| Comp Ex. 3 | Portra II | r | $D_c$ | 1.32 | 1.10 | 1.3 |
| | | g | $D_m$ | 0.91 | 1.0 | 1.3 |
| | | b | $D_y$ | 1.15 | 1.2 | 1.2 |
| Comp Ex. 4 | Fuji-FA3 | r | $D_c$ | 1.56 | 0.8 | 3.0 |
| | | g | $D_m$ | 1.30 | 0.8 | 2.5 |
| | | b | $D_y$ | 1.18 | 0.7 | 2.3 |
| Comp Ex. 5 | Fuji-P | r | $D_c$ | 1.45 | 1.1 | 2.6 |
| | | g | $D_m$ | 1.05 | 0.9 | 2.1 |
| | | b | $D_y$ | 1.15 | 1.0 | 2.0 |
| Invention | | r | $D_c$ | 1.88 | 0.8 | 3.8 |

TABLE 4-continued

| | Coating | Color Record | | 250 ppi Fill-In Dmax (Status A) | Fill-In Range (Log E) | Peak Gamma |
|---|---|---|---|---|---|---|
| Ex. 1 | | g | $D_m$ | 1.42 | 0.7 | 2.7 |
| | | b | $D_y$ | 1.91 | 0.6 | 4.7 |
| Invention | | r | $D_c$ | 2.10 | 0.8 | 5.1 |
| Ex. 2 | | g | $D_m$ | 1.52 | 0.7 | 3.7 |
| | | b | $D_y$ | 2.00 | 0.6 | 5.1 |
| Invention | | r | $D_c$ | 1.94 | 0.7 | 5.1 |
| Ex. 3 | | g | $D_m$ | 1.65 | 0.7 | 3.3 |
| | | b | $D_y$ | 2.06 | 0.6 | 5.4 |

TABLE 5

| | Coating | Color Record | | 250 ppi Fill-In Dmax (Status A) | Fill-In Range (Log E) | Peak Gamma |
|---|---|---|---|---|---|---|
| Comp Ex. 1 | Edge | r | $D_{c'}$ | 1.57 | 1.10 | 2.5 |
| | | g | $D_{m'}$ | 1.59 | 1.1 | 2.2 |
| | | b | $D_{y'}$ | 1.24 | 1.0 | 1.5 |
| Comp Ex. 2 | Edge II | r | $D_{c'}$ | 1.70 | 1.3 | 2.5 |
| | | g | $D_{m'}$ | 1.57 | 1.1 | 2.1 |
| | | b | $D_{y'}$ | 1.20 | 0.9 | 1.6 |
| Comp Ex. 3 | Portra II | r | $D_{c'}$ | 1.74 | 1.4 | 1.7 |
| | | g | $D_{m'}$ | 1.12 | 1.1 | 1.6 |
| | | b | $D_{y'}$ | 1.06 | 1.1 | 1.3 |
| Comp Ex. 4 | Fuji-FA3 | r | $D_{c'}$ | 1.77 | 1.2 | 3.0 |
| | | g | $D_{m'}$ | 1.50 | 1.1 | 2.5 |
| | | b | $D_{y'}$ | 1.46 | 0.9 | 2.4 |
| Comp Ex. 5 | Fuji-P | r | $D_{c'}$ | 2.10 | 1.2 | 2.8 |
| | | g | $D_{m'}$ | 1.35 | 1.1 | 2.0 |
| | | b | $D_{y'}$ | 1.35 | 1.0 | 2.2 |
| Invention | | r | $D_{c'}$ | 2.06 | 0.8 | 4.1 |
| Ex. 1 | | g | $D_{m'}$ | 1.86 | 0.8 | 3.4 |
| | | b | $D_{y'}$ | 2.03 | 0.7 | 5.1 |
| Invention | | r | $D_{c'}$ | 2.25 | 1.0 | 4.5 |
| Ex. 2 | | g | $D_{m'}$ | 1.96 | 0.8 | 3.6 |
| | | b | $D_{y'}$ | 2.06 | 0.7 | 5.4 |
| Invention | | r | $D_{c'}$ | 2.44 | 1.0 | 5.0 |
| Ex. 3 | | g | $D_{m'}$ | 2.16 | 0.8 | 4.1 |
| | | b | $D_{y'}$ | 2.09 | 0.6 | 5.8 |

Invention Examples 1, 2, and 3 produce sharp, high density continuous tone prints with minimal digital fringing.

The invention has been described in detail with particular reference to preferred embodiments thereof, but it will be understood that variations and modifications can be effected within the spirit and scope of the invention.

We claim:

1. A photographic element comprising a layer comprising a cyan dye forming coupler, a layer comprising a magenta dye forming coupler and a layer comprising a yellow dye forming coupler, wherein said all coupler containing layers further comprise silver halide emulsions sensitive to visible light, and said emulsions comprise greater than 95 percent chloride and said element when exposed at less than 50 microseconds per pixel in each color record and at a resolution between 200 and 500 pixels per inch provides after development a maximum gamma between 3.4 and 6.0 in at least one color record layer within a log exposure range not exceeding 1.1 and a fill-in Dmax in the cyan dye forming layer, designated $D_c$, that is $\geqq 1.7$;

a fill-in Dmax in the magenta dye forming layer, designated $D_m$, that is $\geqq 1.4$, a fill-in Dmax in the yellow dye forming layer, designated $D_y$, that is $\geqq 1.3$, and a fill-in exposure range in each color record that is $\leqq 1.1$ log E.

2. The element of claim 1 wherein said layer comprising a cyan dye forming coupler and sensitive to red light has a maximum gamma of 3.8 to 5.5.

3. The element of claim 1 wherein said layer comprising a magenta dye forming coupler and sensitive to green light has a maximum gamma of 3.8 to 4.5.

4. The element of claim 1 wherein said layer comprising a yellow dye forming coupler and sensitive to blue light has a maximum gamma between 3.8 to 4.5.

5. The element of claim 1 wherein at least one of the layers comprises an emulsion doped with at least one member selected from the group consisting of Fe, Co, Ni, Ru, Rh, Pd, Os, Re, and Ir.

6. The element of claim 5 wherein said Group VIII metal comprises at least one of osmium, iridium, or ruthenium.

7. The element of claim 1 wherein said element when subjected to Print Method 1 at 500 pixels per inch has the following characteristics after development:

a fill-in Dmax in the cyan dye forming layer, designated $D_c$, that is $\geqq 2.0$;

a fill-in Dmax in the magenta dye forming layer, designated $D_m$, that is $\geqq 1.8$, a fill-in Dmax in the yellow dye forming layer, designated $D_y$, that is $\geqq 1.6$, and a fill-in exposure range in each color record that is $\leqq 1.1$ log E.

8. The element of claim 1 wherein the said element exposed at 50 microseconds per pixel is exposed with an exposure device comprising three lasers emitting at wavelengths between 400 nm and 750 nm.

9. The element of claim 8 wherein said three lasers comprise a blue light emitting laser wherein the peak wavelength of the blue light emitting laser lies between 430 and 490 nm, a green light emitting laser wherein the peak wavelength of the green emitting laser lies between 510 nm and 560 nm, and a red light emitting laser wherein the peak wavelength of the red emitting laser lies between 600 nm and 700 nm.

10. The element of claim 9 wherein the blue light emitting laser emits at one of the following wavelengths: 454 nm, 458 nm, 465 nm, 472 nm, 476 nm, 488 nm, 496 nm.

11. The element of claim 9 wherein the green light emitting laser emits at one of the following wavelengths: 514 nm, 520 nm, 528 nm, 532 nm, 543 nm, 568 nm, 594 nm.

12. The element of claim 9 wherein the red light emitting laser emits at one of the following wavelengths: 632 nm, 670 nm, 690 nm.

13. The element of claim 1 wherein the said element exposed at 50 microseconds per pixel is exposed with an exposure device comprising light emitting diodes (LEDs) emitting at wavelengths between 400 nm and 750 nm.

14. The element of claim 1 wherein all three color record layers have a maximum gamma after development between 3.4 and 6.0 within a log exposure range not exceeding 1.1.

15. A method of providing a photographic image comprising providing a photographic element comprising a cyan layer comprising a cyan dye forming coupler, a magenta layer comprising a magenta dye forming coupler and a yellow layer comprising a yellow dye forming coupler, wherein said all coupler containing layers further comprise silver halide emulsions sensitive to visible light, and said emulsions comprise greater than 95 percent chloride, exposing said element at less than 50 microseconds per pixel in each color record and at a resolution between 200 and 500 pixels per inch, and developing said element to provide a maximum gamma between 3.4 and 6.0 in at least one color record layer within a log exposure range not exceeding 1.1 and a fill-in Dmax in the cyan layer, designated $D_{c'}$, that is $\geqq 1.7$, a fill-in Dmax in the magenta layer, designated $D_{m'}$, that is $\geqq 1.4$, a fill-in Dmax in the yellow layer, designated $D_{y'}$, that is $\geqq 1.3$, and a fill-in exposure range in each color record that is $\leqq 1.1$ log E.

16. The method of claim 15 wherein said layer comprising a cyan dye forming coupler and sensitive to red light has a maximum gamma of 3.8 to 5.5.

17. The method of claim 15 wherein said layer comprising a magenta dye forming coupler and sensitive to green light has a maximum gamma of 3.8 to 4.5.

18. The method of claim 15 wherein said layer comprising a yellow dye forming coupler and sensitive to blue light has a maximum gamma between 3.8 to 4.5.

19. The method of claim 15 wherein at least one of the layers comprises an emulsion doped with a at least one member selected from the group consisting of Fe, Co, Ni, Ru, Rh, Pd, Os, Re, and Ir.

20. The method of claim 19 wherein said Group VIII metal comprises at least one of osmium, iridium, or ruthenium.

21. The method of claim 15 wherein said element is subjected to Print Method 1 at 500 pixels per inch has the following characteristics after development:

a fill-in Dmax in the cyan layer, designated $D_c$, that is $\geqq 2.0$;

a fill-in Dmax in the magenta layer, designated $D_m$, that is $\geqq 1.8$, a fill-in Dmax in the yellow layer, designated $D_y$, that is $\geqq 1.6$, and a fill-in exposure range in each color record that is $\leqq 1.1$ log E.

22. The method of claim 15 wherein the said exposing method utilizes an exposure device comprising three lasers emitting at wavelengths between 400 nm and 750 nm.

23. The method of claim 15 wherein all three color record layers have a maximum gamma after development between 3.4 and 6.0 within a log exposure range not exceeding 1.1.

* * * * *